US011619112B2

(12) United States Patent
Park et al.

(10) Patent No.: US 11,619,112 B2
(45) Date of Patent: Apr. 4, 2023

(54) ROTATING CUTTER APPARATUS FOR REDUCING THE SIZE OF SOLID OBJECTS IN A FLUID

(71) Applicant: Halliburton Energy Services, Inc., Houston, TX (US)

(72) Inventors: Steven Park, Edmonton (CA); Bipinkumar Singh, Vadodara (IN); Christopher Paul Crampton, Alva (GB); Daniel Soares Goncalves, Houston, TX (US); Philip Leung, Edmonton (CA); Brad McClurg, Porter, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 592 days.

(21) Appl. No.: 16/489,284

(22) PCT Filed: Oct. 22, 2018

(86) PCT No.: PCT/CA2018/051333
§ 371 (c)(1),
(2) Date: Aug. 27, 2019

(87) PCT Pub. No.: WO2020/082153
PCT Pub. Date: Apr. 30, 2020

(65) Prior Publication Data
US 2020/0232303 A1 Jul. 23, 2020

(51) Int. Cl.
*E21B 11/00* (2006.01)
*B02C 18/08* (2006.01)
*E21B 37/02* (2006.01)
*E21B 12/06* (2006.01)

(52) U.S. Cl.
CPC ..... *E21B 37/02* (2013.01); *B02C 18/08* (2013.01); *E21B 11/00* (2013.01); *E21B 12/06* (2013.01)

(58) Field of Classification Search
CPC ..... E21B 11/00; E21B 41/00; B02C 18/08
See application file for complete search history.

(56) References Cited

U.S. PATENT DOCUMENTS 1,502,675 A 7/1924 Johnston
2,250,670 A * 7/1941 Joy ..... E21B 10/44 175/323
2,852,202 A 9/1958 Ditting et al.
(Continued)

*Primary Examiner* — Shane Bomar
(74) *Attorney, Agent, or Firm* — Parlee McLaws LLP; Patrick Laycock; Craig Roddy

(57) ABSTRACT

A rotating cutter apparatus including a housing having a housing interior surface defining a housing bore, a shaft extending through the housing bore such that an annular space is provided between the housing interior surface and the shaft, and at least one cutter carried on the shaft. The shaft is rotatable relative to the housing about a shaft axis. The at least one cutter extends radially toward the housing interior surface and is rotatable relative to the housing about the shaft axis. A method for reducing a size of solid objects contained in a fluid, including providing a rotating cutter apparatus, introducing the fluid containing the solid objects into the rotating cutter apparatus, and rotating a shaft and at least one cutter in order to reduce the size of the solid objects while passing the fluid through the rotating cutter apparatus.

17 Claims, 10 Drawing Sheets

(56) References Cited

U.S. PATENT DOCUMENTS

| | | | | |
|---|---|---|---|---|
| 3,835,942 | A * | 9/1974 | Leonardi | E21B 10/322 175/173 |
| 3,880,367 | A | 4/1975 | Grover | |
| 4,027,824 | A | 6/1977 | Fuller | |
| 4,373,592 | A | 2/1983 | Dellinger et al. | |
| 4,605,175 | A | 8/1986 | Weber | |
| 4,821,966 | A | 4/1989 | Ephraim et al. | |
| 4,967,649 | A | 11/1990 | Ephraim et al. | |
| 5,058,814 | A | 10/1991 | Ephraim et al. | |
| 6,981,561 | B2 | 1/2006 | Krueger et al. | |
| 6,997,272 | B2 * | 2/2006 | Eppink | E21B 47/09 175/215 |
| 7,497,260 | B2 | 3/2009 | Telfer | |
| 8,157,014 | B2 * | 4/2012 | Hariharan | E21B 21/066 241/46.06 |
| 8,783,359 | B2 * | 7/2014 | Reed | E21B 21/06 241/257.1 |
| 8,844,850 | B2 | 9/2014 | He | |
| 9,578,989 | B2 | 2/2017 | Laegdsgaard | |
| 9,611,700 | B2 * | 4/2017 | Zhou | E21B 12/00 |
| 9,980,610 | B2 | 5/2018 | Sahli et al. | |
| 10,538,983 | B2 * | 1/2020 | Mahajan | E21B 10/42 |
| 11,401,748 | B2 * | 8/2022 | Kontras | E21B 10/22 |
| 2005/0098349 | A1 * | 5/2005 | Krueger | E21B 21/00 175/48 |
| 2010/0108393 | A1 | 5/2010 | John et al. | |
| 2010/0147593 | A1 * | 6/2010 | Hariharan | E21B 21/066 175/207 |
| 2010/0155067 | A1 * | 6/2010 | Tunget | E21B 41/00 175/320 |
| 2011/0049025 | A1 | 3/2011 | Davis et al. | |
| 2015/0240567 | A1 * | 8/2015 | Grable | E21B 33/138 175/57 |

* cited by examiner

ROTATING CUTTER APPARATUS FOR REDUCING THE SIZE OF SOLID OBJECTS IN A FLUID

TECHNICAL FIELD

The invention is directed to a rotating cutter apparatus and a method for reducing the size of solid objects contained in a fluid.

BACKGROUND

Solid objects contained in a fluid such as a drilling fluid may be detrimental to drilling operations conducted with a drilling system because such solid objects may plug or otherwise interfere with components of the drilling system. For example, a drill bit may include ports which may become plugged by solid objects such as pieces of elastomer which become separated from a power section of a downhole drilling motor.

BRIEF DESCRIPTION OF DRAWINGS

Embodiments will now be described with reference to the accompanying drawings, in which:

FIG. 8 is a transverse section view of the assembly depicted in FIG. 7.

DETAILED DESCRIPTION

Figure 1:
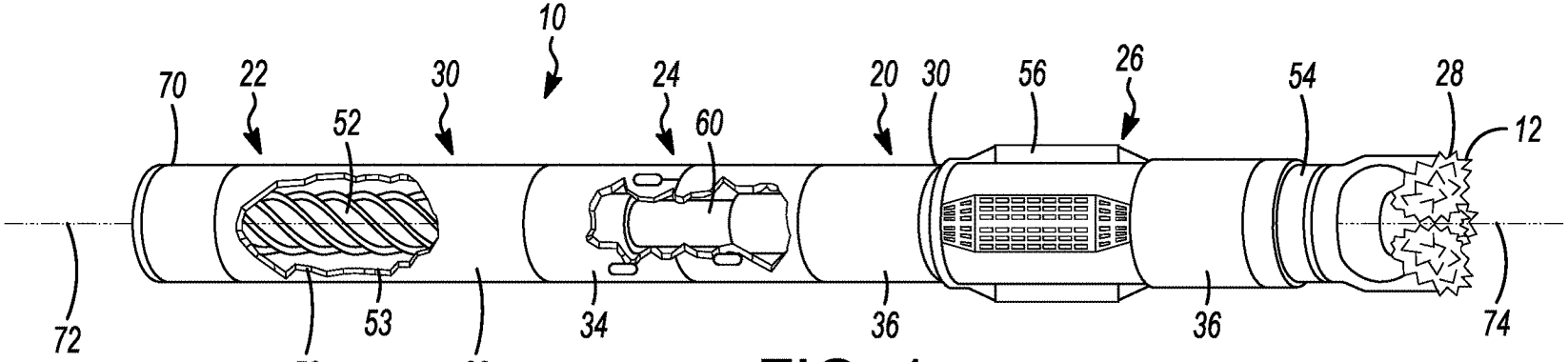
FIG. 1 is a pictorial partial cutaway view of components of a drilling system for use in drilling a borehole, including a drill string, a drilling motor, and a drill bit.

This description is directed, in part, to a rotating cutter apparatus and a method for reducing the size of solid objects contained in a fluid to avoid or mitigate detrimental effects to equipment such as a downhole motor that may otherwise result from the presence of such solid objects in the fluid.

The rotating cutter apparatus and the method may be used in any suitable environment in which it is necessary or desirable to reduce the size of solid objects contained in a fluid.

As a non-limiting example, the rotating cutter apparatus may be included as a component of an apparatus which is configured to be inserted into a borehole, in which case the apparatus may be any suitable apparatus which may be inserted into a borehole for any purpose. As non-limiting examples, the apparatus may be an apparatus for use in drilling, completing, servicing, logging, or surveying a borehole.

As a non-limiting example, the apparatus may be a drilling system for use in drilling a borehole. As non-limiting examples, a drilling system may comprise drill pipe, a downhole drilling motor, a rotary steerable drilling apparatus, a turbine, a reciprocating hammer, and/or any other structure, device or apparatus which may be used in the drilling of a borehole.

As a non-limiting example, a drilling system may have a proximal end and a distal end. A drill bit may be axially located at the distal end of the drilling system. A downhole drilling motor may be axially located between the proximal end and the distal end of the drilling system. The downhole drilling motor may comprise a power section. During use, a fluid such as a drilling fluid may be circulated through the drilling system from the proximal end to the distal end. The rotating cutter apparatus may be included as a component of the drilling system to reduce the size of solid objects which may be contained in the fluid which is circulated through the drilling system.

In a particular non-limiting example, the power section of a downhole drilling motor may comprise a stator and a rotor.

The rotating cutter apparatus may be axially located between the power section of the downhole drilling motor and the drill bit so that solid objects such as pieces of elastomer which become separated from the power section may be reduced in size before they reach the drill bit. In such circumstances, the rotating cutter apparatus may be axially located at any position between the power section of the downhole drilling motor and the drill bit. As a first non-limiting example, the rotating cutter apparatus may be axially located immediately distal of the power section. As a second non-limiting example, the downhole drilling motor may further comprise a transmission section which is axially located distal of the power section and the rotating cutter apparatus may be located distal of the transmission section. As a third non-limiting example, the downhole drilling motor may further comprise a bearing section which is axially located distal of the power section and/or the transmission section and the rotating cutter apparatus may be axially located distal of the bearing section.

The rotating cutter apparatus may be included as a component of an apparatus such as a drilling system in any suitable manner. As a first non-limiting example, the rotating cutter apparatus may be a separate component which is incorporated into a drilling system. The rotating cutter apparatus as a separate component may be incorporated into the drilling system in any suitable manner, including as non-limiting examples by one or more threaded connections, by welding, by fasteners, and/or by an interference fit. As a second non-limiting example, the rotating cutter apparatus may be integral with the drilling system or with a component of the drilling system.

The rotating cutter apparatus comprises a housing, a shaft, and at least one cutter.

The housing has a proximal end, a distal end, and a housing interior surface. The housing interior surface defines a housing bore which extends through the housing from the proximal end to the distal end. The housing bore has a housing bore diameter. The housing may comprise, consist of, or consist essentially of any structure which is capable of providing the housing bore. The housing may comprise a single unitary housing component or the housing may comprise a plurality of housing components which are connected together.

The shaft has a proximal end and a distal end. The shaft extends through the housing bore such that an annular space is provided in the housing bore between the housing interior surface and the shaft. The shaft has a shaft axis. The shaft is rotatable relative to the housing about the shaft axis in a shaft rotating direction. The shaft may comprise, consist of, or consist essentially of any structure which is capable of performing the functions of the shaft. The shaft may comprise a single unitary shaft component or the shaft may comprise a plurality of shaft components which are connected together. The shaft may be solid or the shaft may define a shaft bore. The housing and the shaft are configured so that at least a portion of a fluid passing through the housing bore passes through the annular space.

The shaft has a shaft diameter. The shaft diameter may be constant or may vary axially between the proximal end and the distal end of the shaft.

At least one cutter is carried on the shaft. The one or plurality of cutters are rotatable relative to the housing about the shaft axis. The one or plurality of cutters are carried on the shaft so that the cutter or cutters extend radially toward the housing interior surface.

A cutter may contribute to reducing the size of solid objects which are contained in a fluid passing through the annular space by the rotating movement of the cutter against the solid objects as the solid objects pass through the annular space. This rotating movement of the cutter may contribute to reducing the size of solid objects by imparting a cutting, shearing, chopping, grinding, or other suitable severing action to the solid objects.

A cutter may be carried on the shaft in any manner which enables the cutter to rotate relative to the housing. A cutter may be integral with the shaft or a cutter may be connected with and/or mounted on the shaft in any suitable manner. A cutter may comprise a single unitary cutter component or a cutter may comprise a plurality of cutter components which are connected together.

A cutter may comprise, consist of, or consist essentially of any structure, device, or apparatus and may have any shape and/or configuration which is capable of providing a suitable severing action as it rotates. A cutter has a radial dimension and an axial dimension. As non-limiting examples, a cutter may be shaped generally as a disc, a cylinder, a cone, a truncated cone, or as any other suitable shape.

A cutter may provide a suitable severing action in any suitable manner. As non-limiting examples, a cutter may comprise an abrasive cutter and/or a toothed cutter.

An abrasive cutter may comprise any abrasive material or combination of materials which is capable of facilitating a suitable severing action of the cutter. As a non-limiting example, an abrasive cutter may comprise suitable abrasive grains. The abrasive material may be configured in any suitable manner to facilitate a suitable severing action of the cutter on the solid objects which are contained in the fluid. As a non-limiting example, the abrasive grains may be bonded in a suitable matrix material. Non-limiting examples of abrasive grain materials include diamond, aluminum oxide, ceramics, silicon carbine, zirconium oxide, cubic boron nitride, tungsten carbide, or any other material which is capable of cutting the solid objects. Non-limiting examples of matrix materials include resin, epoxy, rubber, metal, and/or glass, or any other material which is capable of providing a suitable matrix for the abrasive grains.

A toothed cutter may comprise one cutting tooth or any number of a plurality of cutting teeth. The toothed cutter and/or one cutting tooth or plurality of cutting teeth may be constructed of any material or combination of materials which is capable of facilitating a suitable severing action of the cutter on the solid objects which are contained in the fluid. As non-limiting examples, the toothed cutter and/or one cutting tooth or plurality of cutting teeth may be constructed of a suitable steel, stainless steel and/or alloy steel. The one cutting tooth or plurality of cutting teeth may be configured in any suitable manner to facilitate a suitable severing action of the cutter. As non-limiting examples, the one cutting tooth or plurality of cutting teeth may have any suitable shape, width, spacing, frequency, depth, rake angle, clearance angle, set, kerf, pitch, and/or other characteristic. The one cutting tooth or plurality of cutting teeth on a toothed cutter may be arranged in any suitable manner on the cutter. As a non-limiting example, a plurality of cutting teeth on a toothed cutter may be spaced circumferentially around the cutter. A plurality of cutting teeth may be spaced circumferentially around a cutter either evenly or unevenly.

As a first non-limiting example, a cutter may be a helical cutter. A helical cutter may generally have a radial dimension and a significant axial dimension. As non-limiting examples, a helical cutter may generally be shaped as a cylinder, a cone, or a truncated cone. A helical cutter may comprise one helical cutting tooth or any number of a plurality of helical cutting teeth. The one or plurality of helical cutting teeth may have any suitable shape, width, spacing, frequency, depth, rake angle, clearance angle, set, kerf, pitch, spiral angle, and/or other characteristic. The one or plurality of helical cutting teeth may spiral toward the distal end of the housing for an axial length of the helical cutting teeth. The one or plurality of helical cutting teeth may spiral for all or a portion of the axial dimension of the helical cutter. A plurality of helical cutting teeth may be spaced circumferentially around the helical cutter, either evenly or unevenly.

The one or plurality of helical cutting teeth may spiral in a left helical direction or a right helical direction toward the distal end of the shaft. The helical direction of the helical cutting teeth may be the same as the shaft rotating direction or may be opposite to the shaft rotating direction.

As a second non-limiting example, a cutter may be a transverse cutter. A transverse cutter may generally have a radial dimension and a minimal axial dimension. As a non-limiting example, a transverse cutter may generally be shaped as a disc. A transverse cutter may comprise one transverse cutting tooth or any number of a plurality of transverse cutting teeth. The one or plurality of transverse cutting teeth may have any suitable shape, width, spacing, frequency, depth, rake angle, clearance angle, set, kerf, and/or other characteristic. The one or plurality of transverse cutting teeth may be arranged in a cutting plane. The cutting plane may be perpendicular or substantially perpendicular to the shaft axis. A plurality of transverse cutting teeth may be spaced circumferentially around the transverse cutter, either evenly or unevenly.

A cutter radial clearance may be provided between a cutter and the housing interior surface. The cutter radial clearance may generally facilitate reducing the size of the solid objects which are contained in the fluid passing through the annular space while allowing the fluid to pass through the annular space. The cutter radial clearance may be minimal if the cutter comprises gaps or otherwise allows the fluid to pass the cutter and through the annular space substantially unimpeded.

The cutter radial clearance of a cutter may be constant or variable in the axial direction. A variable cutter radial clearance in the axial direction may be provided in any suitable manner. As a first non-limiting example, the housing bore diameter adjacent to a cutter may be variable in the axial direction. As a second non-limiting example, a cutter may have a variable radial dimension in the axial direction.

As a non-limiting example, the cutter radial clearance of a cutter having a significant axial dimension may decrease axially toward the distal end of the housing along at least a portion of the axial length of the cutter or the cutter teeth to a minimum cutter radial clearance. Reducing the size of the solid objects in circumstances of a variable cutter radial clearance may possibly be assisted by providing a variable cutter radial clearance which reduces to a minimum cutter radial clearance, which may function to guide or funnel the fluid towards the minimum cutter radial clearance.

As a particular non-limiting example, a cutter radial clearance for a helical cutter may decrease axially toward the distal end of the housing along at least a portion of the axial length of the helical cutting teeth to a minimum cutter radial clearance. As non-limiting examples, the decrease in the cutter radial clearance may be caused by a decrease axially in the housing bore diameter adjacent to at least the portion of the axial length of the helical cutting teeth toward the distal end of the housing, and/or by an increase axially in the radial dimension of the helical cutter and/or the shaft diameter along at least the portion of the axial length of the helical cutting teeth toward the distal end of the housing.

One or more shearing surfaces may be provided adjacent to a cutter. A shearing surface may generally assist in the reducing of size of the solid objects which are contained in the fluid passing through the annular space. A shearing surface may be provided in any suitable manner. As a non-limiting example, a shearing surface may be a surface which does not rotate with the cutter, such as a surface provided by or associated with the housing. A shearing surface may be parallel or substantially parallel to a cutting plane of a cutter. A cutter axial clearance may be provided between a cutter and the shearing surface. The cutter axial clearance may be minimal if the cutter comprises gaps or otherwise allows the fluid to pass the cutter and the shearing surface and through the annular space substantially unimpeded.

As a particular non-limiting example, a shearing surface may be provided adjacent to a transverse cutter. The shearing surface may have a shearing surface plane which is substantially parallel to the cutting plane of the transverse cutter. A cutter axial clearance may be provided between the transverse cutter and the shearing surface. The housing may comprise one or any number of a plurality of housing projections which may provide the shearing surface. A plurality of housing projections may be spaced circumferentially around the housing interior surface. One or more gaps may be provided in a housing projection or between adjacent housing projections of a plurality of housing projections. The one or more gaps may assist in allowing the fluid to move past the cutter and the shearing surface and through the annular space.

The housing interior surface may be generally smooth. Alternatively, all or a portion of the housing interior surface may be contoured and/or may comprise or define one or any number of a plurality of housing cutters. As non-limiting examples, all or a portion of the housing interior surface may comprise one or any number of a plurality of housing discontinuities, housing textures, abrasive housing cutters, and/or toothed housing cutters, which may be configured or arranged in any manner which facilitates a suitable severing action of the cutters which are carried on the shaft. As non-limiting examples, one or a plurality of housing discontinuities and/or housing cutters may be arranged transverse to the shaft axis or may spiral toward the distal end of the housing in a helical direction. The helical direction of the housing discontinuities and/or housing cutters may be the same direction or the opposite direction as the helical direction of the helical cutting teeth of a helical cutter which is carried on the shaft. A contoured housing interior surface and/or one or more housing cutters may complement the severing action of the one or plurality of cutters which are carried on the shaft.

As previously indicated, the rotating cutter apparatus comprises at least one cutter which is carried on the shaft. The rotating cutter apparatus may therefore comprise one or a plurality of cutters which are carried on the shaft. A plurality of cutters which are carried on the shaft may be identical or similar to each other or some or all of the plurality of cutters may be different from each other. A plurality of cutters may be arranged to be axially located relative to each other in any order or configuration.

As a non-limiting example, the rotating cutter apparatus may comprise a first cutter and a second cutter, wherein the first cutter and the second cutter may each comprise, consist of, or consist essentially of any structure, device, or apparatus and may each have any shape and/or configuration which is capable of providing a suitable severing action as it rotates.

In a particular non-limiting example, the first cutter may be a helical cutter as previously described, comprising one or any number of a plurality of helical cutting teeth spaced circumferentially around the first cutter and the second cutter may be a transverse cutter as previously described, comprising one or any number of a plurality of transverse cutting teeth spaced circumferentially around the second cutter.

In the particular non-limiting example, the second cutter may be axially located between the first cutter and the distal end of the housing or the second cutter may be axially located between the first cutter and the proximal end of the housing.

In the particular non-limiting example, the one or a plurality of helical cutting teeth of the first cutter may spiral toward the distal end of the housing for an axial length of the helical cutting teeth. A plurality of helical cutting teeth of the first cutter may be spaced circumferentially around the first cutter, either evenly or unevenly.

In the particular non-limiting example, the one or a plurality of transverse cutting teeth of the second cutter may be arranged in a cutting plane. The cutting plane may be substantially perpendicular to the shaft axis. A plurality of transverse cutting teeth of the second cutter may be spaced circumferentially around the second cutter, either evenly or unevenly. The helical cutting teeth of the first cutter may spiral toward the distal end of the shaft in a helical direction which is the same direction or the opposite direction as the shaft rotating direction.

In the particular non-limiting example, a first cutter radial clearance may be provided between the first cutter and the housing interior surface. The first cutter radial clearance may be constant or variable. In the case of a variable first cutter radial clearance, the first cutter radial clearance may decrease axially toward the distal end of the housing along at least a portion of the axial length of the helical cutting teeth of the first cutter to a minimum first cutter radial clearance. The housing bore diameter adjacent to at least the portion of the axial length of the helical cutting teeth of the first cutter may decrease axially and/or the radial dimension of the first cutter and/or the shaft diameter may increase axially toward the distal end of the housing in order to cause the first cutter radial clearance to decrease to the minimum first cutter radial clearance. A variable first cutter radial clearance and a minimum first cutter radial clearance may possibly assist in the reducing of size of the solid objects while allowing the fluid to pass through the annular space.

In the particular non-limiting example, a second cutter radial clearance may be provided between the second cutter and the housing interior surface. The second cutter radial clearance may be minimal if the second cutter comprises gaps or otherwise allows the fluid to pass the second cutter and through the annular space substantially unimpeded.

In the particular non-limiting example, the rotating cutter apparatus may comprise a shearing surface adjacent to the second cutter. The shearing surface may have a shearing surface plane which is substantially parallel to the cutting plane of the second cutter. A second cutter axial clearance may be provided between the second cutter and the shearing surface. The second cutter axial clearance may be minimal if the second cutter comprises gaps or otherwise allows the fluid to pass the second cutter and the shearing surface and through the annular space substantially unimpeded.

In the particular non-limiting example, the housing may comprise one or any number of a plurality of housing projections spaced circumferentially around the housing interior surface. One or a plurality of gaps may be provided in a housing projection or between adjacent housing projections of a plurality of housing projections. The one housing projection or the plurality of housing projections may provide the shearing surface.

A method for reducing a size of solid objects contained in a fluid may be performed using a rotating cutter apparatus. The method may be performed using the rotating cutter apparatus described herein or using any other suitable rotating cutter apparatus comprising a housing, a shaft, and at least one cutter.

In a non-limiting example, the method for reducing a size of solid objects contained in a fluid may comprise introducing the fluid containing the solid objects into an annular space and rotating one or a plurality of cutters in the annular space in order to reduce the size of the solid objects while allowing the fluid to pass through the annular space.

In a particular non-limiting example, the method for reducing a size of solid objects contained in a fluid may comprise providing a housing having a proximal end, a distal end, and a housing interior surface, wherein the housing interior surface defines a housing bore which extends through the housing from the proximal end to the distal end, providing a shaft extending through the housing bore such that an annular space is provided in the housing bore between the housing interior surface and the shaft, wherein the shaft has a shaft axis, wherein the shaft is rotatable relative to the housing about the shaft axis, providing at least one cutter carried on the shaft, wherein the at least one cutter is rotatable relative to the housing about the shaft axis, and wherein the at least one cutter extends radially toward the housing interior surface, introducing a fluid containing solid objects into the annular space at the proximal end of the housing, and rotating the shaft and the at least one cutter in order to reduce the size of the solid objects while passing the fluid through the annular space to the distal end of the housing.

The method for reducing a size of solid objects in a fluid may be used in any circumstances in which it is necessary or desirable to reduce the size of solid objects. The solid objects may be pre-existent in a fluid or a slurry comprising a fluid and the solid objects may be prepared in order to use the method.

The method for reducing a size of solid objects in a fluid may be used in any suitable environment and/or with any suitable configuration of apparatus. The method may be used to treat and/or remediate fluids and/or solids. The fluid may be any substance in a fluid state, such as a liquid or a gas. The solid objects may be any substance in a solid or semi-solid state.

As a non-limiting example, the method may be used to reduce the size of solid objects in a fluid circulating through a drilling system. The drilling system may comprise a downhole drilling motor. The downhole drilling motor may comprise a power section. The power section may comprise a stator and a rotor. The stator and/or the rotor may comprise an elastomer for providing a seal between the stator and the rotor. The fluid may comprise a drilling fluid which is circulated through the drilling system. The solid objects may comprise pieces of elastomer which become separated from the power section of the downhole drilling motor during use of the drilling system. Additionally or alternatively, the solid objects may comprise other debris which may be contained in the drilling fluid.

A drill bit may be axially located at a distal end of the drilling system. The method may be used to reduce the size of the solid objects which become separated from the power section of the downhole drilling motor before the solid objects reach the drill bit. As a result, the method may be performed after the fluid is circulated through the power section but before the fluid is circulated through the drill bit.

FIGS. 1-24 are exemplary only. The rotating cutter apparatus and the method may be used in any suitable apparatus and in any suitable application.

In the description of the exemplary embodiments which follows, features which are identical or equivalent in the exemplary embodiments may be identified with the same reference numbers.

Referring to FIG. 1, components of a drilling system (10) for use in drilling a borehole (not shown), including an exemplary downhole drilling motor (20), are depicted in a pictorial partial cutaway view. The drilling motor comprises a power section (22) and a bearing section (26). The bearing section (26) is axially distal to the power section (22). One or more sections of the drilling motor (20) may be axially interposed between the power section (22) and the bearing section (26). As depicted in FIG. 1, the drilling motor (20) further comprises a transmission section (24) which is axially interposed between the power section (22) and the bearing section (26). These sections of the drilling motor (20) constitute components of a powertrain which utilizes fluid energy to rotate a drill bit (28). A drill string (70) is connected directly or indirectly with the proximal end of the power section (22).

The drilling motor (20), the drill bit (28), and the drill string (70) are components of the drilling system (10). The drilling system (10) has a distal end (12). The drill bit (28) is axially located at the distal end (12) of the drilling system (10).

The sections of the drilling motor (20) are contained within a tubular motor housing (30).

As depicted in FIG. 1, the motor housing (30) comprises a plurality of motor housing sections connected together with threaded connections, including a tubular power housing (32) for the power section (22), a tubular transmission housing (34) for the transmission section (24), and a tubular bearing housing (36) for the bearing section (26).

The power housing (32) may comprise a plurality of power housing components which together provide the power housing (32), or the power housing (32) may be a unitary power housing (32) which is formed from a single power housing component.

The transmission housing (34) may comprise a plurality of transmission housing components which together provide the transmission housing (34), or the transmission housing (34) may be a unitary transmission housing (34) which is formed from a single transmission housing component.

The bearing housing (36) may comprise a plurality of bearing housing components which together provide the bearing housing (36), or the bearing housing (36) may be a unitary bearing housing (36) which is formed from a single bearing housing component.

The power section (22) of the drilling motor (20) comprises a stator (50) and a rotor (52). The stator (50) is fixedly connected with the power housing (32), and the rotor (52) is rotatable within the stator (50) in response to a drilling fluid (not shown) circulating through the drilling system (10) to the distal end (12) of the drilling system (10), including through the power section (22). The drill bit (28) comprises ports (not shown) which allow the drilling fluid to be expelled from the drilling system (10) and to be circulated back to the ground surface through an annular space (not shown) which is formed between the borehole and the drilling system (10) during drilling of the borehole. The ports also assist in cleaning debris from the end of the borehole because the drilling fluid is expelled from the ports at a relatively high velocity.

As depicted in FIG. 1, the power section (22) is a Moineau-type power section in which the stator (50) and the rotor (52) are lobed. The rotor (52) has one fewer lobe than the stator (50), and rotates eccentrically within the stator (50). As depicted in FIG. 1, the stator (50) is lined with an elastomer (53), which provides a seal between the stator (50) and the rotor (52) and accommodates the eccentric movement of the rotor (52) within the stator (50).

The transmission section (24) converts the eccentric movement of the rotor (52) to concentric rotation of a driveshaft (54) within the bearing section (26). The transmission section (24) also transmits rotational drive energy from the power section (22) to the bearing section (26).

As depicted in FIG. 1, the transmission section (24) comprises the transmission housing (34) and a transmission member or transmission shaft (60) which is connected between the rotor (52) and the driveshaft (54) such that eccentric rotation of the rotor (52) results in concentric rotation of the transmission shaft (60), and rotation of the transmission shaft (60) causes rotation of the driveshaft (54).

As depicted in FIG. 1, the bearing section (26) comprises the bearing housing (36), the driveshaft (54) and a bearing assembly (not shown in FIG. 1) comprising one or more thrust bearings and radial bearings which rotatably support the driveshaft (54) within the housing (30). As depicted in FIG. 1, the bearing section (26) also comprises a stabilizer (56) which is threadably connected with the exterior of the bearing housing (36).

As depicted in FIG. 1, the drill bit (28) is connected directly or indirectly with the distal end of the driveshaft (54) so that rotation of the driveshaft (54) causes rotation of the drill bit (28).

The drilling motor (20) has a primary axis (72) and the driveshaft (54) has a driveshaft axis (74). As depicted in FIG. 1, the driveshaft axis (74) is oblique to the primary axis (72) so that there is a "bend" in the drilling motor (20). The bend in the drilling motor (20) may be provided by a bend in the exterior of the housing (30), by a bend in the interior of the housing (30), by an articulation of the driveshaft (54) within the housing (30), or in any other suitable manner. The bend in the drilling motor (20) may be fixed (i.e., non-adjustable) or may be adjustable.

A potential problem with the drilling motor (20) depicted in FIG. 1 is that the elastomer (53) which lines the stator (50) may deteriorate or become damaged during use of the drilling motor (20) and solid objects comprising pieces of elastomer (53) may become separated from the power section (22) of the drilling motor (20). Such solid objects may become entrained in the drilling fluid and may be circulated with the drilling fluid through the drilling system (10) toward the distal end (12) of the drilling system (10) and to the drill bit (28). Depending upon the size of the solid objects, the ports in the drill bit may become blocked and/or plugged by the solid objects, which may inhibit circulation of the drilling fluid through the drilling system (10), may negatively affect the performance of the drilling system (10), and/or may cause failure of the drilling system (10) or components of the drilling system (10).

The elastomer (53) may comprise, consist of, or consist essentially of any suitable natural or artificial material which exhibits elasticity similar to that of rubber. As a non-limiting example, the elastomer (53) may comprise, consist of, or consist essentially of a nitrile rubber material, including as non-limiting examples, nitrile butadiene rubber (NBR) and/or hydrogenated nitrile butadiene rubber (HNBR). Nitrile rubber materials are generally relatively resistant to hydrocarbons and other chemicals, have a relatively high wear resistance (e.g., up to about 90 Shore A), have superior strength, but relatively low flexibility. As a result, nitrile rubber materials tend to maintain their shape under stress, are relatively resistant to compression and/or squeezing, and are relatively susceptible to puncture and cutting.

Figure 2:
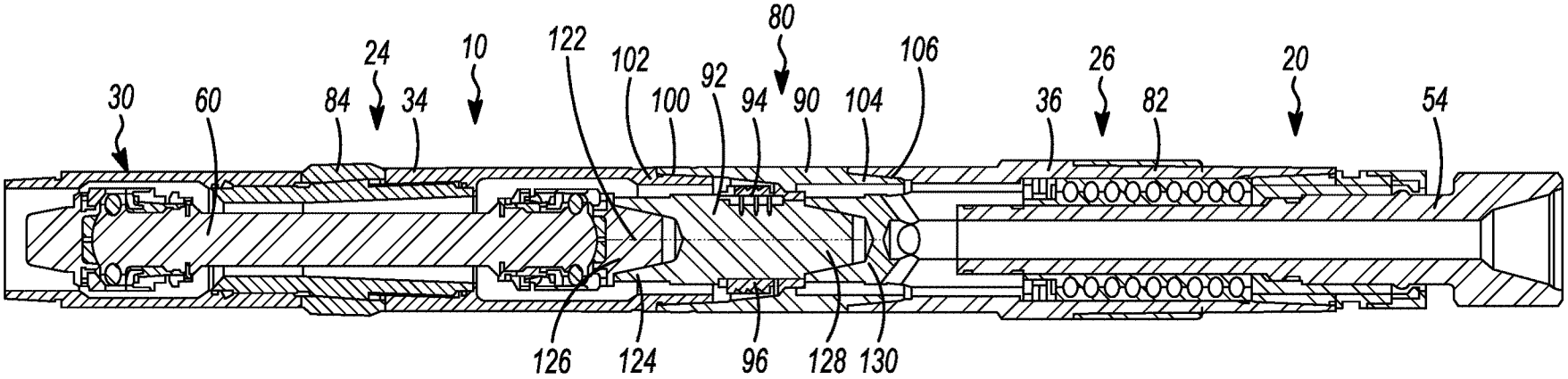
FIG. 2 is a longitudinal section view of components of a drilling system for use in drilling a borehole, including components of an adjustable bend downhole drilling motor and a first exemplary embodiment of a rotating cutter apparatus.

Referring to FIG. 2, components of a drilling system (10) including components of an adjustable bend downhole drilling motor (20) and a first exemplary embodiment of a rotating cutter apparatus (80) are depicted in a longitudinal section view. As depicted in FIG. 2, the rotating cutter apparatus (80) is axially located between the transmission section (24) and the bearing section (26) of the drilling motor (20). As depicted in FIG. 2, the bearing section (26) includes a bearing assembly (82) comprising one or more thrust bearings and radial bearings which rotatably support the driveshaft (54) within the housing (30). The power section (22) of the drilling motor (20) and the drill bit (28) are not depicted in FIG. 2. As depicted in FIG. 2, the adjustable bend in the drilling motor (20) is adjustable by rotating an eccentric collar (84) on the motor housing (30).

Figure 3:
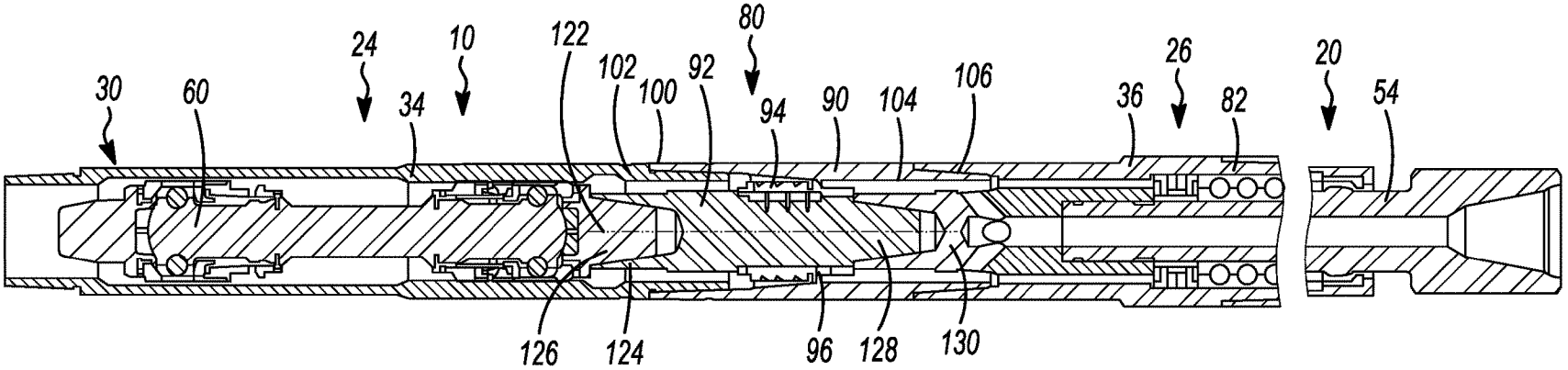
FIG. 3 is a longitudinal section view of components of a drilling system for use in drilling a borehole, including components of a fixed bend downhole drilling motor and the first exemplary embodiment of the rotating cutter apparatus.

Referring to FIG. 3, components of a drilling system (10) including components of a fixed bend downhole drilling motor (20) and the first exemplary embodiment of the rotating cutter apparatus (80) are depicted in a longitudinal section view. As depicted in FIG. 3, the rotating cutter apparatus (80) is axially located between the transmission section (24) and the bearing section (26) of the drilling motor (20). As in the drilling systems (10) depicted in FIGS. 1 and 2, the bearing assembly (82) rotatably supports the driveshaft (54) within the housing (30). The power section (22) of the drilling motor (20) and the drill bit (28) are not depicted in FIG. 3. As depicted in FIG. 3, the fixed bend in the drilling motor (20) is provided by a bend in a component of the motor housing (30) or by an eccentric connection between components of the motor housing (30).

Referring to FIGS. 4-22, the first exemplary embodiment of the rotating cutter apparatus (80) and its components are depicted in detail. In the first exemplary embodiment, the rotating cutter apparatus (80) is configured for use with a drilling motor (20) having a nominal size/diameter of about 172 millimeters (about 6.75 inches). In other embodiments, the rotating cutter apparatus (80) may be adapted for use with drilling motors (20) having a smaller or larger nominal size/diameter.

Figure 4:
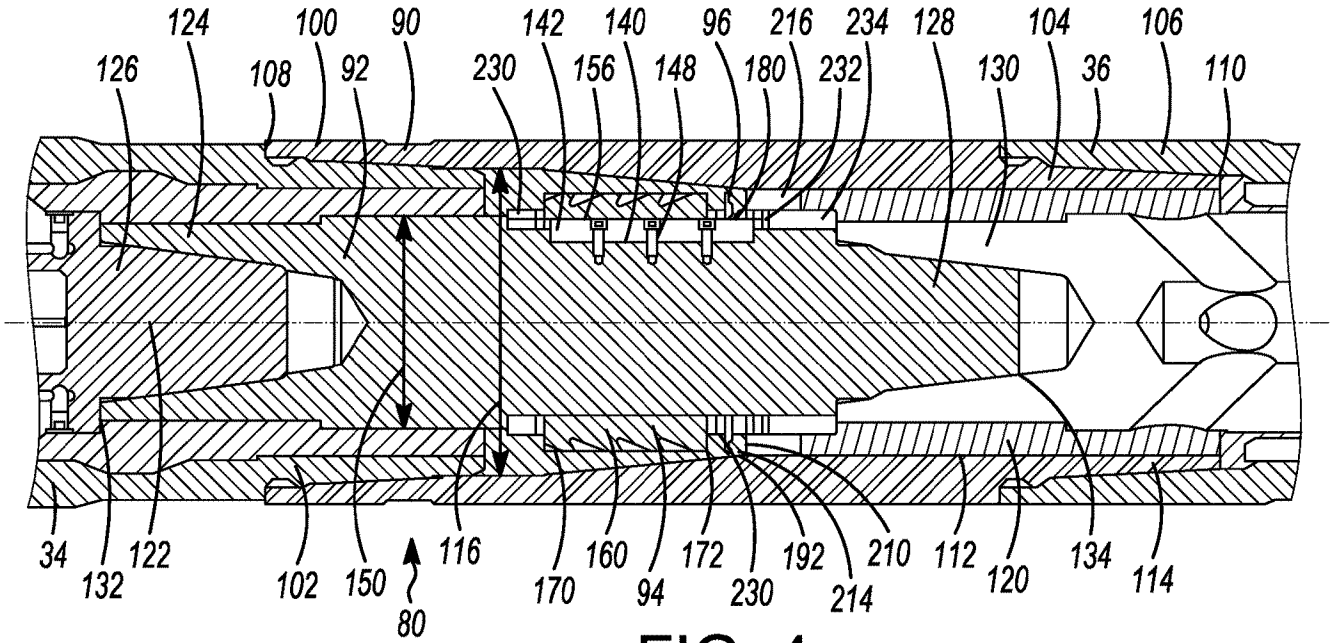
FIG. 4 is a longitudinal section view of the first exemplary embodiment of the rotating cutter apparatus.
Figure 5:
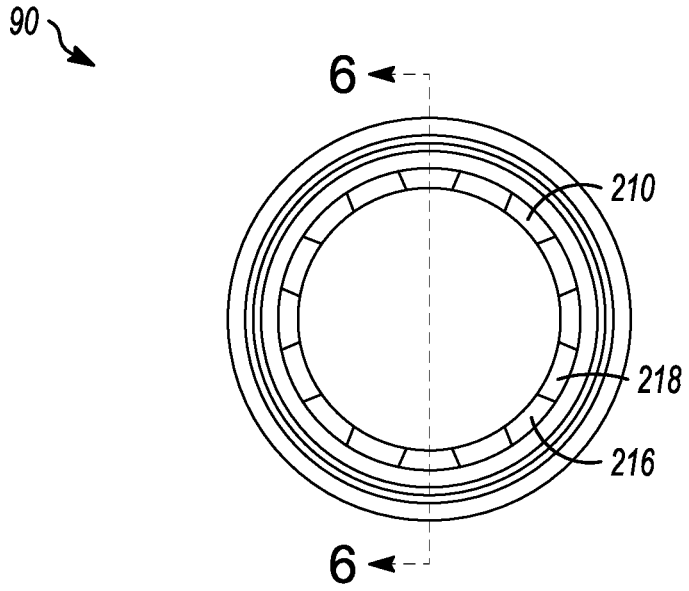
FIG. 5 is an end view of a housing in the first exemplary embodiment of the rotating cutter apparatus depicted in FIG. 4.
Figure 6:
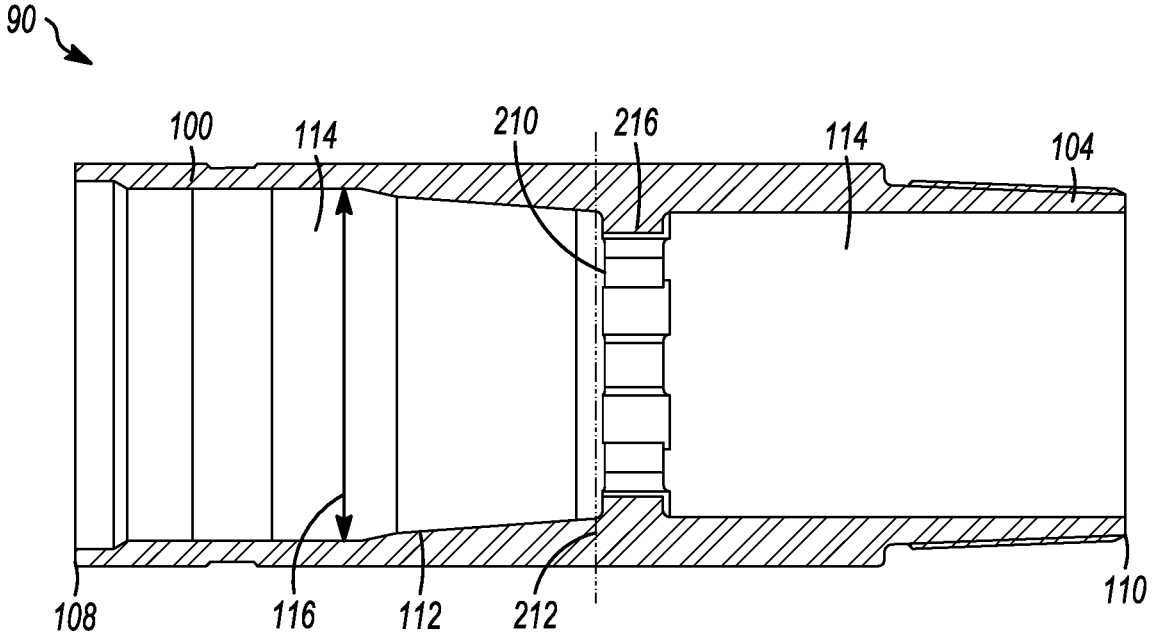
FIG. 6 is a longitudinal section view of the housing depicted in FIG. 5, taken along section line 6-6 in FIG. 5.
Figure 7:
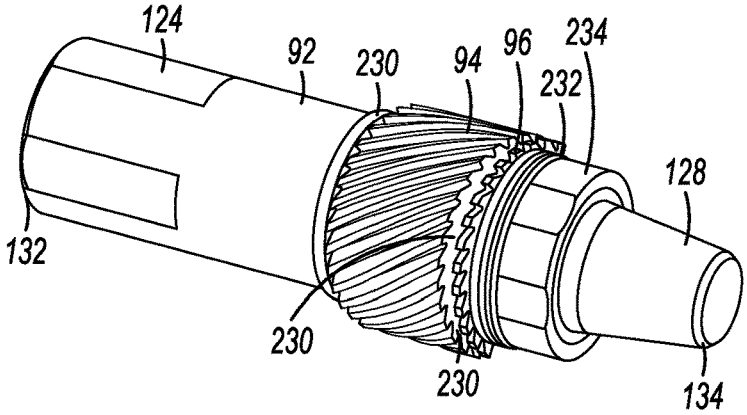
FIG. 7 is a pictorial view of an assembly comprising a shaft, a first cutter, and a second cutter in the first exemplary embodiment of the rotating cutter apparatus depicted in FIG. 4.
Figure 8:
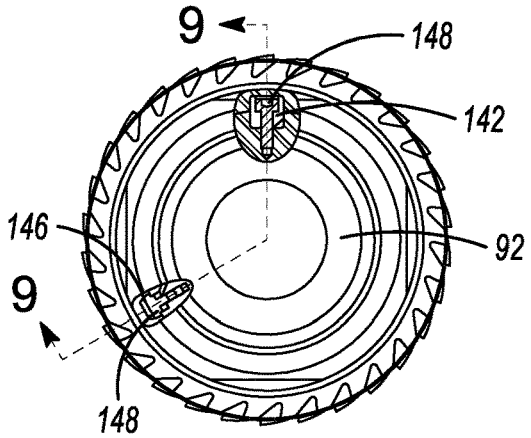
FIG. 8 is

Referring to FIG. 4, the first exemplary embodiment of the rotating cutter apparatus (80) comprises a housing (90), a shaft (92), a first cutter (94), and a second cutter (96).

Referring to FIGS. 2-3 and FIGS. 4-6, in the first exemplary embodiment, the housing (90) is configured as a motor housing section. As a result, the housing (90) is shaped generally as an elongated tube. In other embodiments, the housing (90) may be configured as any other type of suitable structure which is capable of performing the functions of the housing (90).

In the first exemplary embodiment, the housing (90) comprises a proximal box connector (100) which is threadably connected with a complementary pin connector (102) on the transmission housing (34), and a distal pin connector (104) which is threadably connected with a complementary box connector (106) on the bearing housing (36).

The housing (90) has a proximal end (108) which is defined by the proximal box connector (100) and a distal end (110) which is defined by the distal pin connector (104). The housing (90) has a housing interior surface (112). The housing interior surface (112) defines a housing bore (114). The housing bore (114) extends through the housing (90) from the proximal end (108) to the distal end (110) of the housing (90).

The housing bore (114) has a housing bore diameter (116). In the first exemplary embodiment, the housing bore diameter (116) decreases axially toward the distal end (110) of the housing (90) for a portion of the distance between the proximal end (108) and the distal end (110) of the housing (90). In the first exemplary embodiment, the housing bore diameter (116) decreases linearly with a slope of about five degrees, for about 75 millimeters (about 3 inches) axially. In other embodiments, the housing bore diameter (116) may be constant or may decrease non-linearly, at a different rate, for a different distance, and/or to a different extent.

In other embodiments, the housing (90) may have any suitable shape which is capable of providing the housing bore (114). In such other embodiments, the proximal end (108) and the distal end (110) may represent the ends of the housing bore (114), and the housing bore (114) may not necessarily extend along a major dimension or axis of the housing (90). As non-limiting examples, the housing bore (114) may extend through a minor dimension of the housing (90) or may extend through a section of a larger housing structure.

Referring to FIGS. 2-3, FIG. 4, and FIGS. 9-11, in the first exemplary embodiment, the shaft (92) is configured as a component of the powertrain of the drilling motor (20). In other embodiments, the shaft (92) may be configured as any other type of suitable structure which is capable of performing the functions of the shaft (92).

The shaft (92) extends through the housing bore (114) such that an annular space (120) is provided in the housing bore (114) between the housing interior surface (112) and the shaft (92). The shaft (92) has a shaft axis (122). The shaft (92) is rotatable relative to the housing (90) in a shaft rotating direction about the shaft axis (122). In the first exemplary embodiment, the shaft (92) is supported in the housing (90) by bearings in the bearing section (26) of the drilling motor (20). In other embodiments, bearings (not shown) may be provided between the housing (90) and the shaft (92) to rotatably support the shaft (92) within the housing (90).

In the first exemplary embodiment, the shaft (92) is configured to be interposed axially between the transmission shaft (60) and the driveshaft (54) of the drilling motor (20). The shaft (92) comprises a proximal box connector (124) which is threadably connected with a pin connector (126) associated with the transmission shaft (60) and a distal pin connector (128) which is threadably connected with a box connector (130) associated with the driveshaft (54).

The shaft (92) has a proximal end (132) which is defined by the proximal box connector (124) and a distal end (134) which is defined by the distal pin connector (128). In the first exemplary embodiment, the shaft (92) is solid between the proximal box connector (124) and the distal pin connector (128) so that the shaft (92) does not define a shaft bore (not shown). As a result, in the first exemplary embodiment, substantially all of a fluid (not shown) passing through the housing bore (114) passes through the annular space (120). In other embodiments, the shaft (92) may define a shaft bore to provide a fluid bypass of the annular space (120) for all or a portion of the fluid.

Referring to FIGS. 9-13, in the first exemplary embodiment the shaft (92) defines a drive keyway (140) for receiving a drive key (142) and an error proof keyway (144) for receiving an error proof key (146). The keyways (140, 144) and the keys (142, 146) are each provided with a series of three threaded bores to facilitate mounting of the keys (142, 146) in the keyways (140, 144) with suitable fasteners (148).

The drive keyway (140) and the drive key (142) are a different size (i.e., larger) than the error proof keyway (144) and the error proof key (146). In addition, the drive keyway (140) and the drive key (142) are spaced circumferentially relative to the error proof keyway (144) and the error proof key (146) on the shaft (92) by about 120 degrees. The size and configuration of the keyways (140, 144) and their respective keys (142, 146) lessen the possibility that the rotating cutter apparatus (80) will be improperly assembled.

In the first exemplary embodiment, the drive keyway (140) and the drive key (142) are about 95 millimeters (about 3.7 inches) long and about 11 millimeters (about 0.43 inches) wide, and the error proof keyway (144) and the error proof key (146) are about 95 millimeters long (about 3.7 inches) and about 6 millimeters (about 0.24 inches) wide.

Figure 10:
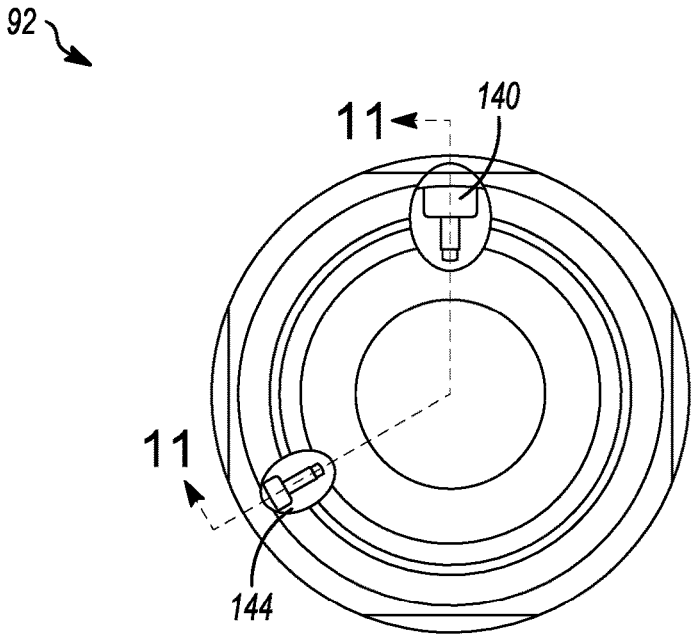
FIG. 10 is a transverse section view of a shaft in the first exemplary embodiment of the rotating cutter apparatus depicted in FIG. 4.
Figure 11:
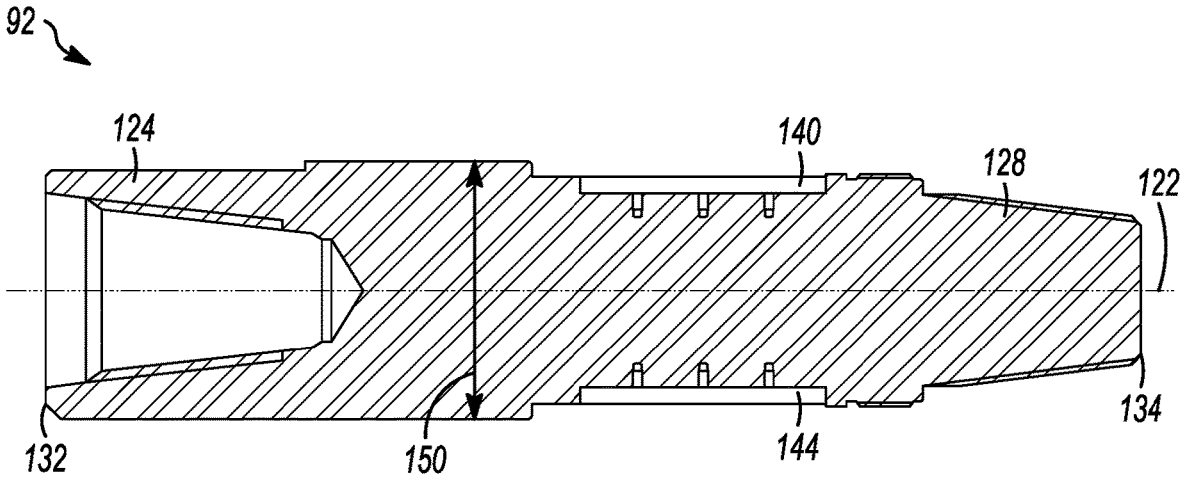
FIG. 11 is a longitudinal section view of the shaft depicted in FIG. 10, taken along section line 11-11 in FIG. 10.
Figure 12:
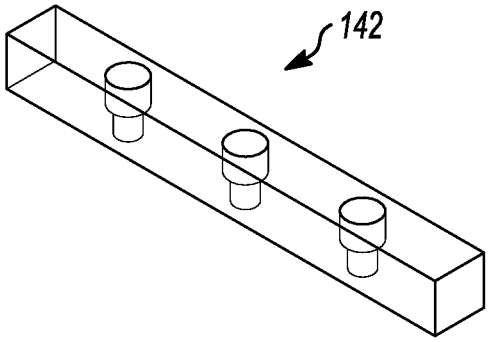
FIG. 12 is a pictorial view of a drive key in the first exemplary embodiment of the rotating cutter apparatus depicted in FIG. 4.
Figure 13:
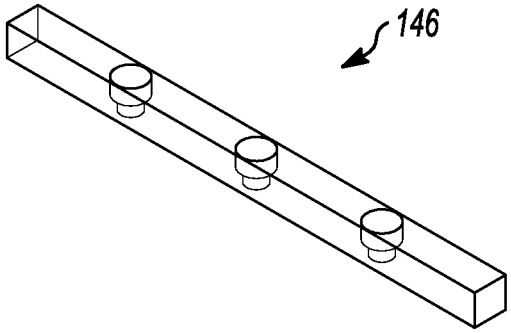
FIG. 13 is a pictorial view of an error proof key in the first exemplary embodiment of the rotating cutter apparatus depicted in FIG. 4.
Figure 14:
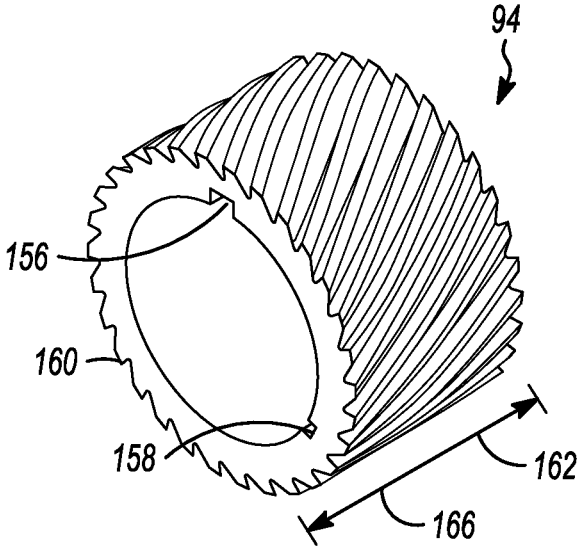
FIG. 14 is a pictorial view of a helical cutter in the first exemplary embodiment of the rotating cutter apparatus depicted in FIG. 4.
Figure 15:
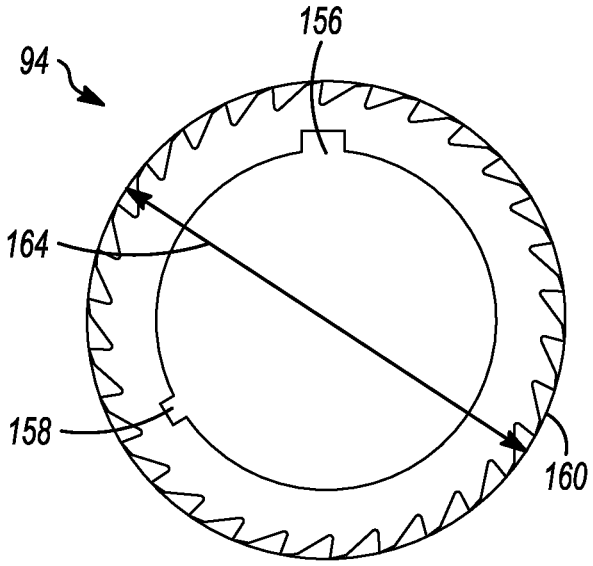
FIG. 15 is an end view of the helical cutter depicted in FIG. 14.
Figure 16:
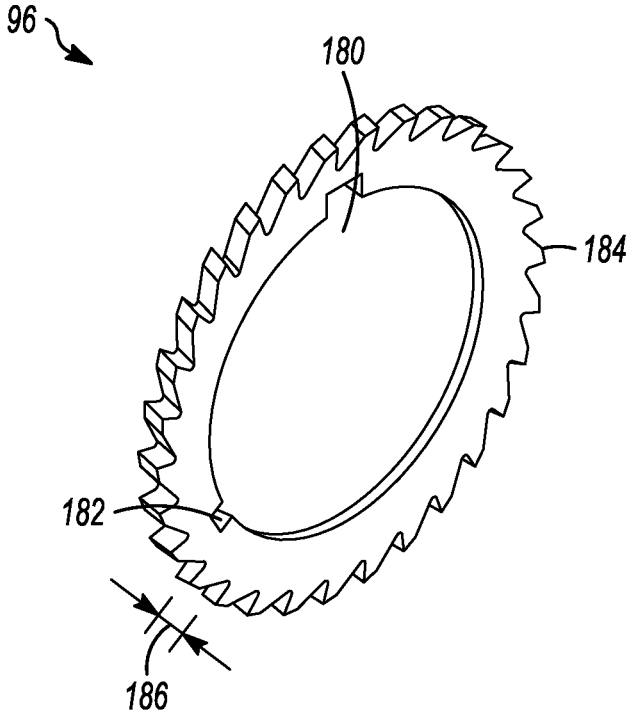
FIG. 16 is a pictorial view of a side cutter in the first exemplary embodiment of the rotating cutter apparatus depicted in FIG. 4.
Figure 17:
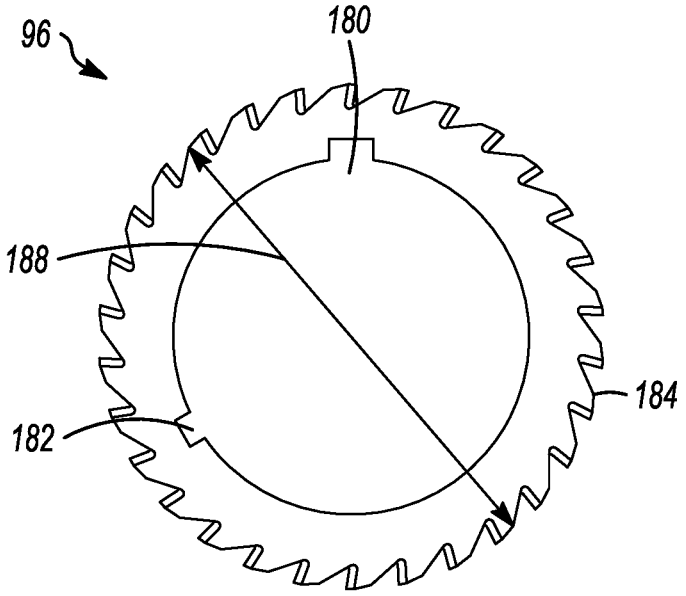
FIG. 17 is an end view of the side cutter depicted in FIG. 16.
Figure 18:
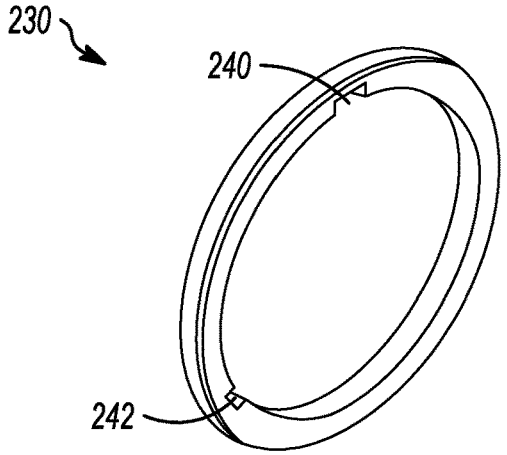
FIG. 18 is a pictorial view of an exemplary spacer in the first exemplary embodiment of the rotating cutter apparatus depicted in FIG. 4.
Figure 19:
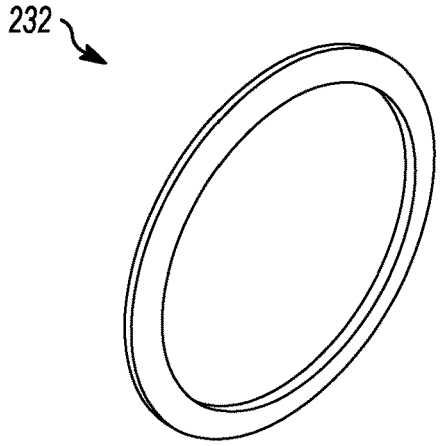
FIG. 19 is a pictorial view of a Belleville disc spring in the first exemplary embodiment of the rotating cutter apparatus depicted in FIG. 4.
Figure 20:
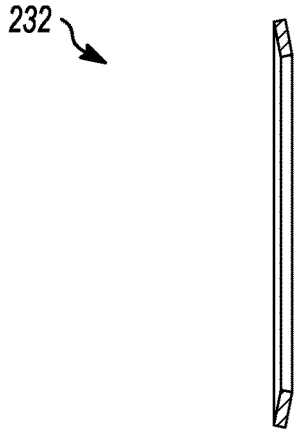
FIG. 20 is a side view of the Belleville disc spring depicted in FIG. 20.
Figure 21:
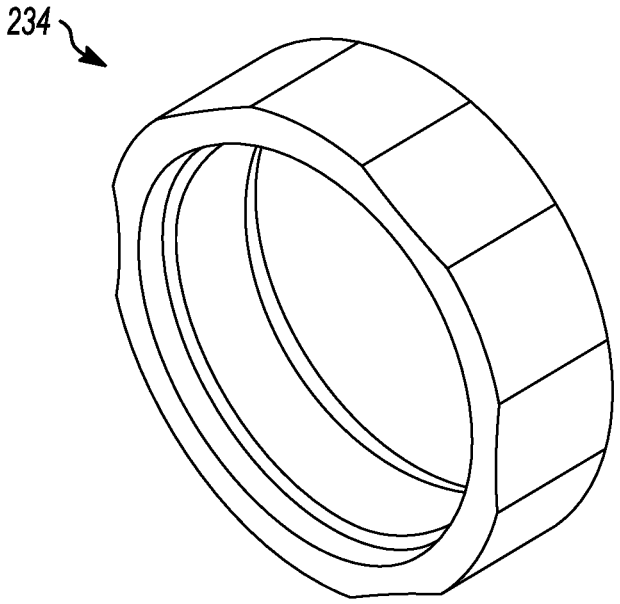
FIG. 21 is a pictorial view of a locking nut in the first exemplary embodiment of the rotating cutter apparatus depicted in FIG. 4.
Figure 22:
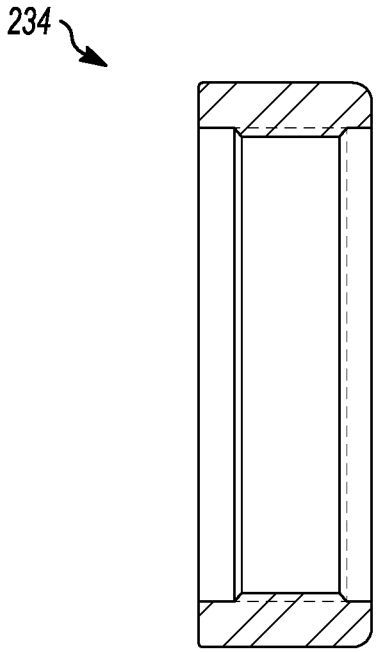
FIG. 22 is a longitudinal section view of the locking nut depicted in FIG. 22.

Referring to FIG. 4 and FIGS. 10-11, the shaft (92) has a shaft diameter (150). In the first exemplary embodiment, the shaft diameter (150) varies between the proximal end (132) and the distal end (134) of the shaft (92) to complement the configuration of the housing bore (114) and to accommodate the cutters (94, 96) and other components of the rotating cutter apparatus (80).

Referring to FIGS. 2-3, FIG. 4, and FIGS. 7-9 and FIGS. 14-17, in the first exemplary embodiment the rotating cutter apparatus (80) comprises the first cutter (94) and the second cutter (96). In other embodiments, the rotating cutter apparatus (80) may comprise one cutter or may comprise any number of more than two cutters. In the first exemplary embodiment, the second cutter (96) is axially located between the first cutter (94) and the distal end (110) of the housing (90). In other embodiments, the second cutter (96) may be axially located between the first cutter (94) and the proximal end (108) of the housing (90).

Referring to FIGS. 2-3, FIG. 4, FIGS. 7-9, and FIGS. 14-15, the first cutter (94) is carried on the shaft (92) so that the first cutter (94) extends radially toward the housing interior surface (112). The first cutter (94) is rotatable relative to the housing (90). In the first exemplary embodiment, the first cutter (94) is carried on the shaft (92) such that the first cutter (94) rotates with the shaft (92) about the shaft axis (122).

More particularly, in the first exemplary embodiment, the first cutter (94) defines a drive keyway (156) and an error proof keyway (158) which match the corresponding keyways (140, 144) on the shaft (92). As a result, the first cutter (94) rotates with the shaft (92) as a result of the respective engagement of the drive key (142) and the error proof key (146) with both the keyways (140, 144) on the shaft (92) and the keyways (156, 158) on the first cutter (94).

In the first exemplary embodiment, the first cutter (94) is a helical cutter comprising a plurality of helical cutting teeth (160). The first cutter (94) has a significant axial dimension (162) which is the distance between the ends of the first cutter (94) and a radial dimension (164) which is the radius or diameter of the first cutter (94). In the first exemplary embodiment, the radial dimension (164) of the first cutter (94) is substantially constant so that the first cutter (94) is generally shaped as a cylinder. The helical cutting teeth (160) spiral for an axial length (166) of the helical cutting teeth (160) toward the distal end (110) of the housing (90) and are spaced circumferentially around the first cutter (94). In the first exemplary embodiment, the helical cutting teeth (160) spiral for substantially the entire axial dimension (162) of the first cutter (94). In the first exemplary embodiment, the helical cutting teeth (160) are spaced substantially evenly around the first cutter (94).

The helical cutting teeth (160) of the first cutter (94) spiral in a helical direction which is the direction in which the helical cutting teeth (160) spiral toward the distal end (134) of the shaft (92). The helical direction may be the same direction as the shaft rotating direction or may be the opposite direction as the shaft rotating direction. In the first exemplary embodiment, the helical direction of the helical cutting teeth (160) is opposite to the shaft rotating direction. More particularly, in the first exemplary embodiment, the shaft rotating direction is to the right when viewed toward the distal end (134) of the shaft (92), and the helical direction is to the left when viewed toward the distal end (134) of the shaft (92).

A first cutter radial clearance (170) is provided between the first cutter (94) and the housing interior surface (112). In the first exemplary embodiment, the first cutter radial clearance (170) decreases axially toward the distal end (110) of the housing (90) along substantially the entire axial length of the helical cutting teeth (160) to a minimum first cutter radial clearance (172).

In the first exemplary embodiment, the first cutter radial clearance (170) decreases because the housing bore diameter (116) adjacent to the helical cutting teeth (160) decreases axially toward the distal end (110) of the housing (90), thereby causing the first cutter radial clearance (170) to decrease to the minimum first cutter radial clearance (172). In other embodiments, the first cutter radial clearance (170) may be constant, may decrease because the housing bore diameter (116) decreases and/or because the shaft diameter (150) increases, or may increase because the housing diameter (116) increases and/or because the shaft diameter (150) decreases.

In the first exemplary embodiment, the first cutter (94) is constructed of PM-M4 HRc60-62 high speed tool steel and comprises 30 helical cutting teeth (160), and the helical cutting teeth (160) have a right hand cutting direction, a rake angle of 13 degrees, a spiral angle of 30 degrees, a clearance angle of about 14 degrees, and a flute depth of about 6.35 millimeters (about 0.25 inches).

As a non-limiting example, in the first exemplary embodiment, the rotating cutter apparatus (80) may be configured so that the minimum first cutter radial clearance (172) is about 4 millimeters (about 0.165 inches), which may be achieved with a housing bore diameter (116) of about 131 millimeters (about 5.17 inches) and a radial dimension (164) of the first cutter (94) of about 123 millimeters (about 4.843 inches).

Referring to FIGS. 2-3, FIG. 4, and FIGS. 7-9 and FIGS. 16-17, the second cutter (96) is carried on the shaft (92) so that the second cutter (96) extends radially toward the housing interior surface (112). The second cutter (96) is rotatable relative to the housing (90). In the first exemplary embodiment, the second cutter (96) is carried on the shaft (92) such that the second cutter (96) rotates with the shaft (92) about the shaft axis (122).

More particularly, in the first exemplary embodiment, the second cutter (96) defines a drive keyway (180) and an error proof keyway (182) which match the corresponding keyways (140, 144) on the shaft (92). As a result, the second cutter (96) rotates with the shaft (92) as a result of the respective engagement of the drive key (142) and the error proof key (146) with both the keyways (140, 144) on the shaft (92) and the keyways (180, 182) on the second cutter (96).

In the first exemplary embodiment, the second cutter (96) is a transverse cutter comprising a plurality of transverse cutting teeth (184). The second cutter (96) has a minimal axial dimension (186) which is the thickness of the second cutter (96) and a radial dimension (188) which is the radius or diameter of the second cutter (96). In the first exemplary embodiment, the second cutter (96) is generally shaped as a disc. The transverse cutting teeth (184) are spaced circumferentially around the second cutter (96) in a cutting plane (190). In the first exemplary embodiment, the transverse cutting teeth (184) are spaced substantially evenly around the second cutter (96) and the cutting plane (190) is substantially perpendicular to the shaft axis (122).

A second cutter radial clearance (192) is provided between the second cutter (96) and the housing interior surface (112). In the first exemplary embodiment, the second cutter radial clearance (192) is less than the minimum first cutter radial clearance (172). In other embodiments, the second cutter radial clearance (192) may be equal to or greater than the minimum first cutter radial clearance (172).

In the first exemplary embodiment, the rotating cutter apparatus (80) further comprises a shearing surface (210) adjacent to the second cutter (96). The shearing surface (210) has a shearing surface plane (212) which is substantially parallel to the cutting plane (190) of the second cutter (96). The shearing surface (210) may assist in providing a severing action to the solid objects as they pass by the second cutter (96).

A second cutter axial clearance (214) is provided between the second cutter (96) and the shearing surface (210). In the first exemplary embodiment, the second cutter axial clearance (214) is selected to be sufficiently large to reduce the likelihood that particles of sand, rock, and/or other debris will become lodged between the second cutter (96) and the shearing surface (210) and thus inhibit or prevent rotation of the second cutter (96) relative to the housing (90).

In the first exemplary embodiment, the housing (90) comprises a plurality of housing projections (216) which are spaced circumferentially around the housing interior surface (112), and the housing projections (216) provide the shearing surface (210). In the first exemplary embodiment, gaps (218) are provided between adjacent housing projections (214) to allow the fluid to pass through the annular space (120) substantially unimpeded.

In the first exemplary embodiment, the second cutter (96) is constructed of PM-M4 HRc60-62 high speed tool steel and comprises 30 helical cutting teeth (160), and the helical cutting teeth (160) have a right hand cutting direction, a rake angle of 13 degrees, a clearance angle of about 14 degrees, and a flute depth of about 6.35 millimeters (about 0.25 inches).

As a non-limiting example, in the first exemplary embodiment, the rotating cutter apparatus (80) may be configured so that the second cutter radial clearance (192) is about 2.3 millimeters (about 0.09 inches), which may be achieved with a housing bore diameter (116) of about 130 millimeters (about 5.13 inches) and a radial dimension (164) of the second cutter (96) of about 125 millimeters (about 4.945 inches).

In the first exemplary embodiment, the housing (90), the shaft (92), the first cutter (94), and the second cutter (96) represent the major components of the rotating cutter apparatus (80). In the first exemplary embodiment, the rotating cutter apparatus (80) further comprises one or more spacers (230), one or more Belleville disc springs (232), and a locking nut (234) which facilitate assembly of the rotating cutter apparatus (80).

Referring to FIGS. 2-3, FIG. 4, and FIGS. 7-9 and FIG. 18, an exemplary spacer (230) for use in the rotating cutter apparatus (80) is depicted. In the first exemplary embodiment, the spacer (230) defines a drive keyway (240) and an error proof keyway (242) which match the corresponding keyways (140, 144) on the shaft (92). As a result, the spacer (230) rotates with the shaft (92) as a result of the respective engagement of the drive key (142) and the error proof key (146) with both the keyways (140, 144) on the shaft (92) and the keyways (240, 242) on the spacer (230).

Figure 9:
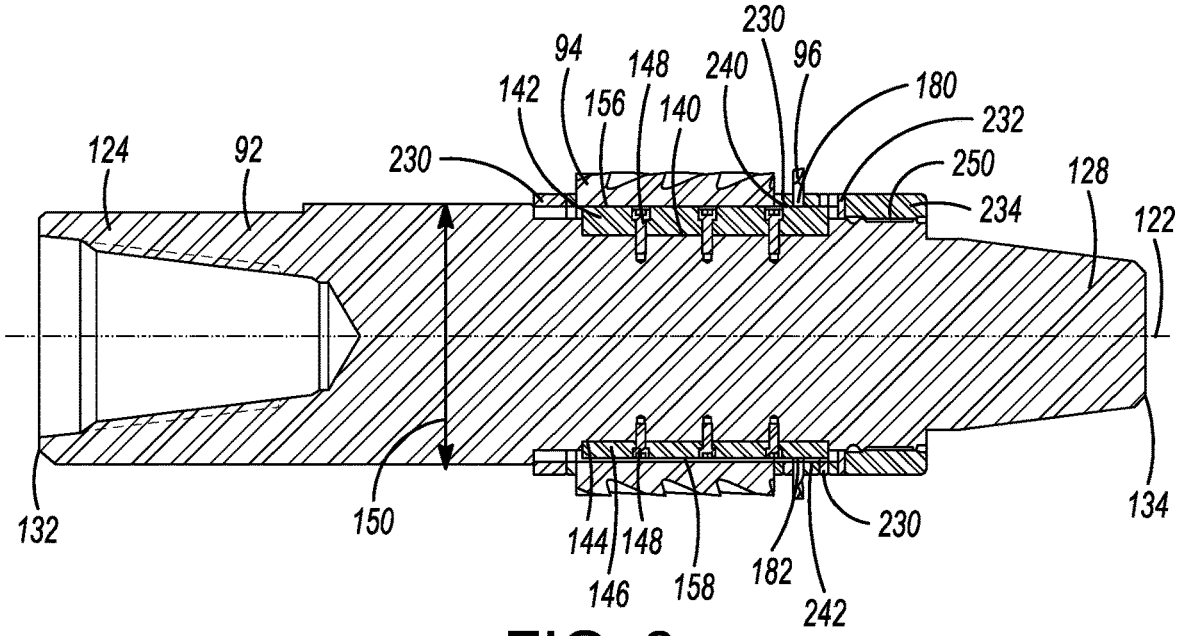
FIG. 9 is a longitudinal section view of the assembly depicted in FIG. 4, taken along section line 9-9 in FIG. 8.

Referring to FIGS. 4 and 9, in the first exemplary embodiment, the rotating cutter apparatus (80) comprises five thin spacers (230) which each have a thickness of about 3.8 millimeters (about 0.15 inches), one medium spacer (230) which has a thickness of about 6.4 millimeters (about 0.25 inches), and one thick spacer (230) which has a thickness of about 12.7 millimeters (about 0.50 inches). The spacers (230) facilitate the desired axial positioning of the first cutter (94) and the second cutter (96) on the shaft (92) relative to the housing (90). In other embodiments, the rotating cutter apparatus (80) may comprise no spacers, a different number of spacers (230), and/or different thicknesses of spacers (230).

Referring to FIGS. 2-3, FIG. 4, and FIGS. 7-9 and FIGS. 19-20, a Belleville disc spring (232) for use in the rotating cutter apparatus (80) is depicted. In the first exemplary embodiment, one Belleville disc springs (232) is used in the rotating cutter apparatus (80) to provide an axial force to assist in maintaining the positioning of the first cutter (94) and the second cutter (96) on the shaft (92). In other embodiments, the rotating cutter apparatus (80) may comprise no Belleville disc springs (232) or a different number of Belleville disc springs (232).

Referring to FIGS. 2-3, FIG. 4, and FIGS. 7-9 and FIGS. 21-22, a locking nut (234) for use in the rotating cutter apparatus (80) is depicted. In the first exemplary embodiment, the locking nut (234) retains the first cutter (94), the second cutter (96), the spacers (230), and the Belleville disc springs (232) in position on the shaft (92). The locking nut (234) is connected with the shaft (92) by a threaded connection (250) between the locking nut (234) and the shaft (92). In other embodiments, the locking nut (234) may be substituted with some other retaining mechanism or mechanisms, including as non-limiting examples, one or more snap rings (not shown) or set screws (not shown).

The first exemplary embodiment of the rotating cutter apparatus (80) may be assembled as follows:

1. the drive key (142) and the error proof key (146) may be mounted in the drive keyway (140) and the error proof keyway (144) respectively on the shaft (92) with the fasteners (148);
2. the thick spacer (230) and one thin spacer (230) may be installed on the shaft (92) from the distal end (134) of the shaft (92) by lining up the keyways (240, 242) on the spacers (230) with the keys (142, 146) on the shaft (92);
3. the first cutter (94) may be installed on the shaft (92) from the distal end (134) of the shaft (92) by lining up the keyways (156, 158) on the first cutter (94) with the keys (142, 146) on the shaft (92), ensuring that the helical cutting teeth (160) of the first cutter (94) are configured for a right hand cutting direction and a left helical direction when viewed toward the distal end (134) of the shaft (92);

4. two thin spacers (230) may be installed on the shaft from the distal end (134) of the shaft (92) by lining up the keyways (240, 242) on the spacers (230) with the keys (142, 146) on the shaft (92);
5. the second cutter (96) may be installed on the shaft (92) from the distal end (134) of the shaft (92) by lining up the keyways (180, 182) on the second cutter (96) with the keys (142, 146) on the shaft (92), ensuring that the transverse cutting teeth (184) on the second cutter (96) are configured for a right hand cutting direction when viewed toward the distal end (134) of the shaft (92);
6. the medium spacer (230) and two thin spacers (230) may be installed on the shaft (92) from the distal end (134) of the shaft (92) by lining up the keyways (240, 242) on the spacers (230) with the keys (142, 146) on the shaft (92);
7. the Belleville disc spring (232) may be installed on the shaft (92) from the distal end (134) of the shaft (92) by sliding the Belleville disc spring (232) onto the shaft (92) until it engages the closest thin spacer (230);
8. the locking nut (234) may be installed on the shaft (92) from the distal end (134) of the shaft (92) by threading the locking nut (234) onto the shaft (92) from the distal end (134) of the shaft (92);
9. the shaft (92) may be connected with the transmission section (24) of a drilling motor (20) by connecting the proximal box connector (124) on the shaft (92) with the pin connector (126) which is associated with the transmission shaft (60);
10. the housing (90) may be connected with the transmission section (24) of the drilling motor (20) by connecting the proximal box connector (100) on the housing (90) with the pin connector (102) on the transmission housing (34); and
11. the bearing section (26) of the drilling motor (20) may be connected with the rotating cutter apparatus (80) by connecting the distal pin connector (128) on the shaft (92) with the box connector (130) associated with the driveshaft (54) and by connecting the distal pin connector (104) on the housing (90) with the box connector (106) on the bearing housing (36).

The first exemplary embodiment of the rotating cutter apparatus (80) may be used during drilling of a borehole by a drilling system (10) as a component of the drilling system (10) and/or the drilling motor (20). During drilling, a fluid such as a drilling fluid may by circulated through the drilling system (10) and the drilling motor (20), causing the transmission shaft (60) and thus the shaft (92), the driveshaft (54), and the drill bit (28) to rotate to the right when viewed toward the distal end (12) of the drilling system (10).

The circulated fluid will pass from the power section (22) of the drilling motor (20) to the transmission section (24) of the drilling motor (20), from the transmission section (24) of the drilling motor (20) to the rotating cutter apparatus (80), from the rotating cutter apparatus (80) to the bearing section (26) of the drilling motor (20), and from the bearing section (26) of the drilling motor (20) to the drill bit (28).

As the circulated fluid passes through the power section (22) of the drilling motor (20), pieces of elastomer (53) may become separated from the power section (22). If such pieces of elastomer (53) are sufficiently large to block the fluid ports in the drill bit (28), the circulation of the fluid may become partially or fully blocked, resulting in an increased pressure within the drilling system (10) and potential stalling and/or damage to the components of the drilling system (10).

Referring to FIG. 4, as the circulated fluid passes through the rotating cutter apparatus (80), the circulated fluid will pass through the annular space (120) between the housing interior surface (112) and the shaft (92). At the proximal end (108) of the housing (90), the passage of the fluid will be essentially unobstructed. As the fluid moves toward the distal end (110) of the housing (90), the fluid encounters the first cutter (94) and the housing bore diameter (116) decreases linearly to provide the minimum first cutter radial clearance (172) at the distal end of the axial length (166) of the helical cutting teeth (160) on the first cutter (94). Pieces of elastomer (53) and/or other debris which are contained in the fluid may be reduced in size by the first cutter (94) by a severing action resulting from the rotation of the first cutter (94) and the configuration of the first cutter (94) and the housing (90).

As the circulated fluid moves further toward the distal end (110) of the housing (90), the fluid encounters the second cutter (96) and the housing projections (216) on the housing (90) adjacent to the second cutter (96). Although the second cutter radial clearance (192) is less than the minimum first cutter radial clearance (172), the passage of the fluid will be essentially unobstructed because of the flutes between adjacent transverse cutting teeth (184) and because of the gaps (218) between adjacent housing projections (216). Pieces of elastomer (53) and/or other debris which are contained in the fluid may be reduced in size by the second cutter (96) by a severing action resulting from the rotation of the second cutter (96) and the configuration of the second cutter (96) and the housing (90).

By providing different types and/or sizes of cutters for the first cutter (94) and the second cutter (96) and by providing that the second cutter radial clearance (192) is less than the minimum first cutter radial clearance (172), pieces of elastomer (53) and/or other debris which are contained in the fluid may possibly be reduced in size to a greater extent than if a single cutter were included in the rotating cutter apparatus (80).

Furthermore, the configuration of the rotating cutter apparatus (80), including the housing (90), the shaft (92), and the cutters (94, 96) may result in a filtering of solid objects by preventing solid objects of greater than a desired size from passing through the rotating cutter apparatus (80) without being reduced to the desired size by the rotating cutter apparatus (80).

As a non-limiting example, a typical port in a drill bit may range from about 6.4 millimeters (about 0.25 inches) to about 24 millimeters (about 0.94 inches) in diameter. In order to pass through the port without clogging the port, a solid object must have at least one dimension which is smaller than the diameter of the port. A typical size of a solid object consisting of a piece of elastomer (53) which becomes separated from a power section (22) of a drilling motor may be about 51 millimeters (about 2 inches) long by about 12.7 millimeters (about 0.5 inches) thick by about 12.7 millimeters (about 0.5 inches) wide. Assuming a port diameter of about 14 millimeters (about 0.56 inches), the first cutter (94) may be configured to reduce the size of the solid objects to no greater than about 25 millimeters (about 1 inch) long by about 8 millimeters (about 0.31 inches) thick by about 8 millimeters (about 0.31 inches) wide, and the second cutter (96) may be configured to reduce the size of the solid objects to no greater than about 8 millimeters (about 0.31 inches) long by about 8 millimeters (about 0.31 inches) thick by about 8 millimeters (about 0.31 inches) wide.

Figure 23:
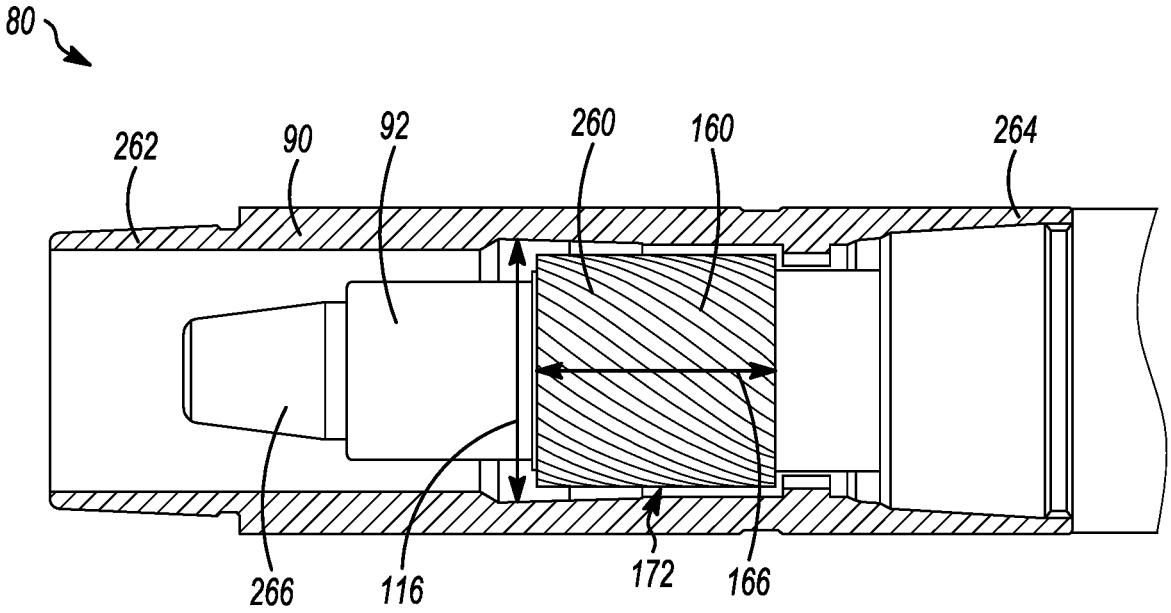
FIG. 23 is a partial longitudinal section view of components of a second exemplary embodiment of a rotating cutter apparatus.

Referring to FIG. 23, components of a second exemplary embodiment of a rotating cutter apparatus (80) are depicted. The description of the second exemplary embodiment is restricted to those features of the second exemplary embodiment which are different from the features of the first exemplary embodiment.

In the second exemplary embodiment, the rotating cutter apparatus (80) comprises a single cutter (260). The single cutter (260) is a helical cutter which is similar in configuration to the first cutter (94) in the first exemplary embodiment. In the second exemplary embodiment, the helical cutting teeth (160) of the single cutter (260) spiral in a right helical direction toward the distal end (134) of the shaft (92) so that the helical direction of the helical cutting teeth (160) of the single cutter (260) is the same as the shaft rotating direction.

In the second exemplary embodiment, the housing bore diameter (116) decreases linearly along only a portion of the axial length (166) of the helical cutting teeth (160) of the single cutter (260) to provide the minimum cutter radial clearance (172) and maintains the minimum cutter radial clearance (172) for the remaining portion of the axial length (166) of the helical cutting teeth (160).

In the second exemplary embodiment, the rotating cutter apparatus (80) is axially located between the power section (22) and the transmission section (24) of the drilling motor (20). More particularly in the second exemplary embodiment, a proximal pin connector (262) on the housing (90) is configured to be connected with a box connector (not shown in FIG. 23) on the power housing (32), a distal box connector (264) on the housing (90) is configured to be connected with a pin connector (not shown in FIG. 23) on the transmission housing (34), a proximal pin connector (266) on the shaft (92) is configured to be connected with a box connector (not shown in FIG. 23) associated with the rotor (52), and a distal connector (not shown in FIG. 23) on the shaft (92) is configured to be connected with a complementary connector (not shown in FIG. 23) associated with the transmission shaft (60).

As a result, in the second exemplary embodiment, the shaft (92) rotates eccentrically within the housing (90) as a result of the eccentric rotation of the rotor (52) within the stator (50) of the power section (22). The eccentric rotation of the shaft (92) within the housing (90) may assist in providing a severing action to solid objects which are contained in the fluid which passes through the rotating cutter apparatus (80), by varying the minimum cutter radial clearance (172) as the shaft (92) rotates within the housing (90).

Figure 24:
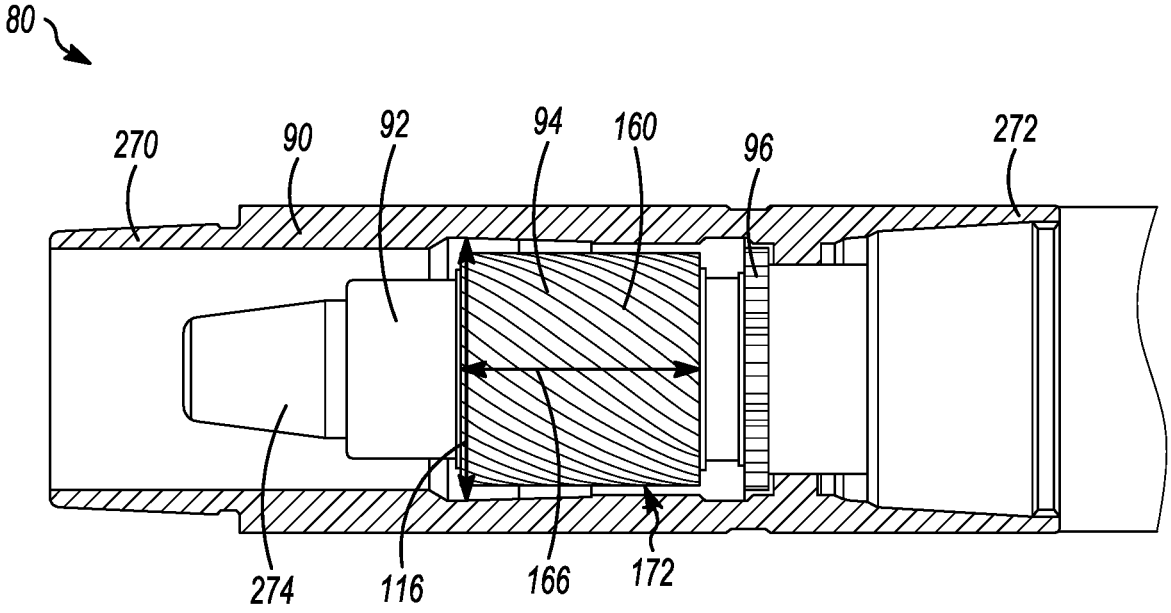
FIG. 24 is a partial longitudinal section view of components of a third exemplary embodiment of a rotating cutter apparatus.

Referring to FIG. 24, components of a third exemplary embodiment of a rotating cutter apparatus (80) are depicted. The description of the third exemplary embodiment is restricted to those features of the third exemplary embodiment which are different from the features of the first exemplary embodiment.

In the third exemplary embodiment, the rotating cutter apparatus (80) comprises a first cutter (94) and a second cutter (96). The first cutter (94) in the third exemplary embodiment is a helical cutter which is similar in configuration to the first cutter (94) in the first exemplary embodiment. In the third exemplary embodiment, the helical cutting teeth (160) of the first cutter (94) spiral in a right helical direction toward the distal end (134) of the shaft (92) so that the helical direction of the helical cutting teeth (160) of the first cutter (94) is the same as the shaft rotating direction. The second cutter (96) in the third exemplary embodiment is similar in configuration to the second cutter (96) in the first exemplary embodiment.

In the third exemplary embodiment, the housing bore diameter (116) decreases linearly along only a portion of the axial length (166) of the helical cutting teeth (160) of the first cutter (94) to provide the minimum cutter radial clearance (172) and maintains the minimum cutter radial clearance (172) for the remaining portion of the axial length (166) of the helical cutting teeth (160).

In the third exemplary embodiment, the rotating cutter apparatus (80) is axially located between the power section (22) and the transmission section (24) of the drilling motor (20). More particularly in the third exemplary embodiment, a proximal pin connector (270) on the housing (90) is configured to be connected with a box connector (not shown in FIG. 24) on the power housing (32), a distal box connector (272) on the housing (90) is configured to be connected with a pin connector (not shown in FIG. 24) on the transmission housing (34), a proximal pin connector (274) on the shaft (92) is configured to be connected with a box connector (not shown in FIG. 24) associated with the rotor (52), and a distal connector (not shown in FIG. 24) on the shaft (92) is configured to be connected with a complementary connector (not shown in FIG. 24) associated with the transmission shaft (60).

As a result, in the third exemplary embodiment, the shaft (92) rotates eccentrically within the housing (90) as a result of the eccentric rotation of the rotor (52) within the stator (50) of the power section (22). The eccentric rotation of the shaft (92) within the housing (90) may assist in providing a severing action to solid objects which are contained in the fluid which passes through the rotating cutter apparatus (80), by varying the minimum first cutter radial clearance (172) and the second cutter radial clearance (192) as the shaft (92) rotates within the housing (90).

A method for reducing a size of solid objects contained in a fluid may comprise providing a rotating cutter apparatus (80) comprising a housing (90), a shaft (92), and at least one cutter, introducing the fluid containing solid objects into the rotating cutter apparatus (80), and rotating the shaft and the at least one cutter in order to reduce the size of the solid objects while passing the fluid through the rotating cutter apparatus (80).

The method may more particularly comprise providing a housing (90) having a proximal end (108), a distal end (110), and a housing interior surface (112), wherein the housing interior surface (112) defines a housing bore (114) which extends through the housing (90) from the proximal end (108) to the distal end (110).

The method may further more particularly comprise providing a shaft (92) extending through the housing bore (114) such that an annular space (120) is provided in the housing bore (114) between the housing interior surface (112) and the shaft (92), wherein the shaft has a shaft axis (122), and wherein the shaft (92) is rotatable relative to the housing (90) about the shaft axis (122).

The method may further more particularly comprise providing at least one cutter carried on the shaft (92), wherein the at least one cutter is rotatable relative to the housing about the shaft axis (122), and wherein the at least one cutter extends radially toward the housing interior surface (112).

The method may further more particularly comprise introducing the fluid containing solid objects into the annular space (120) at the proximal end (108) of the housing (90), and rotating the shaft (92) and the at least one cutter in order to reduce the size of the solid objects while passing the fluid through the annular space (120) to the distal end (110) of the housing (90).

Additional Disclosures

The following are non-limiting, specific embodiments of the rotating cutter apparatus described herein:

Embodiment A. A rotating cutter apparatus comprising:

a housing having a proximal end, a distal end, and a housing interior surface, wherein the housing interior surface defines a housing bore which extends through the housing from the proximal end to the distal end;

a shaft extending through the housing bore such that an annular space is provided in the housing bore between the housing interior surface and the shaft, wherein the shaft is rotatable relative to the housing about a shaft axis; and a cutter carried on the shaft and extending radially toward the housing interior surface, wherein the cutter is rotatable relative to the housing about the shaft axis.

Embodiment B. The rotating cutter apparatus of Embodiment A wherein the cutter is a helical cutter comprising a plurality of helical cutting teeth which are spaced circumferentially around the helical cutter and spiral toward the distal end of the housing for an axial length of the helical cutting teeth.

Embodiment C. The rotating cutter apparatus of Embodiment B wherein a cutter radial clearance is provided between the helical cutter and the housing interior surface, and wherein the cutter radial clearance decreases axially toward the distal end of the housing along at least a portion of the axial length of the helical cutting teeth to a minimum cutter radial clearance.

Embodiment D. The rotating cutter apparatus of Embodiment C wherein the housing bore has a housing bore diameter and wherein the housing bore diameter adjacent to at least the portion of the axial length of the helical cutting teeth decreases axially toward the distal end of the housing, thereby causing the cutter radial clearance to decrease to the minimum cutter radial clearance.

Embodiment E. The rotating cutter apparatus of any one of Embodiments B through D wherein the shaft is rotatable relative to the housing in a shaft rotating direction, and wherein the helical cutting teeth spiral toward the distal end of the housing in a helical direction which is opposite to the shaft rotating direction.

Embodiment F. The rotating cutter apparatus of Embodiment A wherein the cutter is a transverse cutter comprising a plurality of transverse cutting teeth spaced circumferentially around the cutter in a cutting plane which is perpendicular to the shaft axis.

Embodiment G. The rotating cutter apparatus of Embodiment F, further comprising a shearing surface adjacent to the transverse cutter, the shearing surface having a shearing surface plane which is parallel to the cutting plane.

Embodiment H. The rotating cutter apparatus of Embodiment G wherein the housing comprises a plurality of housing projections spaced circumferentially around the housing interior surface with gaps between adjacent housing projections, and wherein the housing projections provide the shearing surface.

Embodiment I. The rotating cutter apparatus of Embodiment A wherein the cutter is a first cutter, wherein the first cutter is a helical cutter comprising a plurality of helical cutting teeth which are spaced circumferentially around the first cutter and spiral toward the distal end of the housing for an axial length of the helical cutting teeth, wherein the rotating cutter apparatus further comprises a second cutter, and wherein the second cutter is a transverse cutter comprising a plurality of transverse cutting teeth spaced circumferentially around the second cutter in a cutting plane which is perpendicular to the shaft axis.

Embodiment J. The rotating cutter apparatus of Embodiment I wherein the second cutter is axially located between the first cutter and the distal end of the housing.

Embodiment K. The rotating cutter apparatus of any one of Embodiments I or J wherein a first cutter radial clearance is provided between the first cutter and the housing interior surface, and wherein the first cutter radial clearance decreases axially toward the distal end of the housing along at least a portion of the axial length of the helical cutting teeth of the first cutter to a minimum first cutter radial clearance.

Embodiment L. The rotating cutter apparatus of any one of Embodiments I through K wherein the housing bore has a housing bore diameter and wherein the housing bore diameter adjacent to at least the portion of the axial length of the helical cutting teeth of the first cutter decreases axially toward the distal end of the housing, thereby causing the first cutter radial clearance to decrease to the minimum first cutter radial clearance.

Embodiment M. The rotating cutter apparatus of any one of Embodiments I through L wherein the shaft is rotatable relative to the housing in a shaft rotating direction, and wherein the helical cutting teeth of the first cutter spiral toward the distal end of the housing in a helical direction which is opposite to the shaft rotating direction.

Embodiment N. The rotating cutter apparatus of any one of Embodiments I through M, further comprising a shearing surface adjacent to the second cutter, the shearing surface having a shearing surface plane which is parallel to the cutting plane of the second cutter.

Embodiment O. The rotating cutter apparatus of Embodiment N wherein the housing comprises a plurality of housing projections spaced circumferentially around the housing interior surface with gaps between adjacent housing projections, and wherein the housing projections provide the shearing surface.

Embodiment P. A drilling system comprising the rotating cutter apparatus of any one of Embodiments A through 0 and a downhole drilling motor for drilling a borehole, the downhole drilling motor comprising a power section.

Embodiment Q. The drilling system of Embodiment P wherein the drilling system comprises a drill bit and wherein the rotating cutter apparatus is axially located between the power section of the downhole drilling motor and the drill bit.

Embodiment R. A method for reducing a size of solid objects contained in a fluid, comprising:

providing the rotating cutter apparatus of any one of Embodiments A through O;

introducing the fluid containing the solid objects into the annular space at the proximal end of the housing; and rotating the shaft and the at least one cutter in order to reduce the size of the solid objects while passing the fluid through the annular space to the distal end of the housing.

Embodiment S. A method for reducing a size of solid objects contained in a fluid, comprising:

providing the drilling system of any one of Embodiments P or Q;

introducing the fluid containing the solid objects into the annular space at the proximal end of the housing; and rotating the shaft and the at least one cutter in order to reduce the size of the solid objects while passing the fluid through the annular space to the distal end of the housing.

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

We claim:

1. A rotating cutter apparatus comprising:

a housing having a proximal end, a distal end, and a housing interior surface, wherein the housing interior surface defines a housing bore which extends through the housing from the proximal end to the distal end and has a housing bore diameter;

a shaft extending through the housing bore such that an annular space is provided in the housing bore between the housing interior surface and the shaft, wherein the shaft is rotatable relative to the housing about a shaft axis; and a cutter carried on the shaft and extending radially toward the housing interior surface, wherein the cutter is rotatable relative to the housing about the shaft axis; and wherein the cutter is a helical cutter comprising a plurality of helical cutting teeth which are spaced circumferentially around the helical cutter and spiral toward the distal end of the housing for an axial length of the helical cutting teeth;

a cutter radial clearance is provided between the helical cutter and the housing interior surface, and decreases axially toward the distal end of the housing along at least a portion of the axial length of the helical cutting teeth to a minimum cutter radial clearance; and the housing bore diameter adjacent to at least the portion of the axial length of the helical cutting teeth decreases axially toward the distal end of the housing, thereby causing the cutter radial clearance to decrease to the minimum cutter radial clearance.

2. The rotating cutter apparatus as claimed in claim 1 wherein the shaft is rotatable relative to the housing in a shaft rotating direction, and wherein the helical cutting teeth spiral toward the distal end of the housing in a helical direction which is opposite to the shaft rotating direction.

3. The rotating cutter apparatus as claimed in claim 1 wherein the cutter is a transverse cutter comprising a plurality of transverse cutting teeth spaced circumferentially around the cutter in a cutting plane which is perpendicular to the shaft axis.

4. The rotating cutter apparatus as claimed in claim 3, further comprising a shearing surface adjacent to the transverse cutter, the shearing surface having a shearing surface plane which is parallel to the cutting plane.

5. The rotating cutter apparatus as claimed in claim 4 wherein the housing comprises a plurality of housing projections spaced circumferentially around the housing interior surface with gaps between adjacent housing projections, and wherein the housing projections provide the shearing surface.

6. The rotating cutter apparatus as claimed in claim 1 wherein the cutter is a first cutter, wherein the first cutter is a helical cutter comprising a plurality of helical cutting teeth which are spaced circumferentially around the first cutter and spiral toward the distal end of the housing for an axial length of the helical cutting teeth, wherein the rotating cutter apparatus further comprises a second cutter, and wherein the second cutter is a transverse cutter comprising a plurality of transverse cutting teeth spaced circumferentially around the second cutter in a cutting plane which is perpendicular to the shaft axis.

7. The rotating cutter apparatus as claimed in claim 6 wherein the second cutter is axially located between the first cutter and the distal end of the housing.

8. The rotating cutter apparatus as claimed in claim 7 wherein a first cutter radial clearance is provided between the first cutter and the housing interior surface, and wherein the first cutter radial clearance decreases axially toward the distal end of the housing along at least a portion of the axial length of the helical cutting teeth of the first cutter to a minimum first cutter radial clearance.

9. The rotating cutter apparatus as claimed in claim 8 wherein the housing bore has a housing bore diameter and wherein the housing bore diameter adjacent to at least the portion of the axial length of the helical cutting teeth of the first cutter decreases axially toward the distal end of the housing, thereby causing the first cutter radial clearance to decrease to the minimum first cutter radial clearance.

10. The rotating cutter apparatus as claimed in claim 8 wherein the shaft is rotatable relative to the housing in a shaft rotating direction, and wherein the helical cutting teeth of the first cutter spiral toward the distal end of the housing in a helical direction which is opposite to the shaft rotating direction.

11. The rotating cutter apparatus as claimed in claim 6, further comprising a shearing surface adjacent to the second cutter, the shearing surface having a shearing surface plane which is parallel to the cutting plane of the second cutter.

12. The rotating cutter apparatus as claimed in claim 11 wherein the housing comprises a plurality of housing projections spaced circumferentially around the housing interior surface with gaps between adjacent housing projections, and wherein the housing projections provide the shearing surface.

13. A drilling system comprising the rotating cutter apparatus as claimed in claim 1 and a downhole drilling motor for drilling a borehole, the downhole drilling motor comprising a power section.

14. The drilling system as claimed in claim 13 wherein the drilling system comprises a drill bit, and wherein the rotating cutter apparatus is axially located between the power section of the downhole drilling motor and the drill bit.

15. A drilling system comprising the rotating cutter apparatus as claimed in claim 6 and a downhole drilling motor for drilling a borehole, the downhole drilling motor comprising a power section.

16. The drilling system as claimed in claim 15 wherein the drilling system comprises a drill bit, and wherein the rotating cutter apparatus is axially located between the power section of the downhole drilling motor and the drill bit.

17. A method for reducing a size of solid objects contained in a fluid, comprising:

providing a housing having a proximal end, a distal end, and a housing interior surface, wherein the housing interior surface defines a housing bore which extends through the housing from the proximal end to the distal end and has a housing bore diameter;

providing a shaft extending through the housing bore such that an annular space is provided in the housing bore between the housing interior surface and the shaft, wherein the shaft is rotatable relative to the housing about a shaft axis;

providing at least one cutter carried on the shaft and extending radially toward the housing interior surface, wherein the at least one cutter is rotatable relative to the housing about the shaft axis; wherein the cutter is a helical cutter comprising a plurality of helical cutting teeth which are spaced circumferentially around the helical cutter and spiral toward the distal end of the housing for an axial length of the helical cutting teeth; a cutter radial clearance is provided between the helical cutter and the housing interior surface, and decreases axially toward the distal end of the housing along at least a portion of the axial length of the helical cutting teeth to a minimum cutter radial clearance; and the housing bore diameter adjacent to at least the portion of the axial length of the helical cutting teeth decreases axially toward the distal end of the housing, thereby causing the cutter radial clearance to decrease to the minimum cutter radial clearance;

introducing the fluid containing the solid objects into the annular space at the proximal end of the housing; and rotating the shaft and the at least one cutter in order to reduce the size of the solid objects while passing the fluid through the annular space to the distal end of the housing.

* * * * *